US010494809B2

(12) United States Patent
Romes

(10) Patent No.: US 10,494,809 B2
(45) Date of Patent: Dec. 3, 2019

(54) INSULATIVE MATERIAL AND METHOD FOR INSTALLATION

(71) Applicant: KNAUF INSULATION, INC., Shelbyville, IN (US)

(72) Inventor: Gary E. Romes, Loveland, OH (US)

(73) Assignee: Knauf Insulation, Inc., Shelbyville, IN (US)

( * ) Notice: Subject to any disclaimer, the term of this patent is extended or adjusted under 35 U.S.C. 154(b) by 0 days.

(21) Appl. No.: 15/642,910

(22) Filed: Jul. 6, 2017

(65) Prior Publication Data

US 2018/0010331 A1 Jan. 11, 2018

Related U.S. Application Data

(60) Provisional application No. 62/448,690, filed on Jan. 20, 2017, provisional application No. 62/359,535, filed on Jul. 7, 2016.

(51) Int. Cl.
*E04B 1/76* (2006.01)
*E04B 1/78* (2006.01)

(52) U.S. Cl.
CPC ..... *E04B 1/7654* (2013.01); *E04B 1/7666* (2013.01); *E04B 1/78* (2013.01)

(58) Field of Classification Search
CPC . E04B 1/7654; E04B 1/78; E04B 1/64; E04B 1/665; E04B 1/7076; E04B 1/7629; E04B 1/7658; E04B 9/001; E04B 1/7666; E04B 1/767
See application file for complete search history.

(56) References Cited

U.S. PATENT DOCUMENTS

| | | | | |
|---|---|---|---|---|
| 1,859,996 | A * | 5/1932 | Simpson | E04B 1/7658 52/406.1 |
| 1,870,838 | A * | 8/1932 | Davis | E04B 1/767 52/407.1 |
| 1,874,659 | A | 8/1932 | Upson | |
| 2,028,253 | A | 1/1936 | Spafford | |
| 2,271,575 | A | 2/1942 | Waterman | |
| 2,342,839 | A | 2/1944 | Byers | |
| 2,576,698 | A | 11/1951 | Russum | |
| 2,742,385 | A | 4/1956 | Bovenkerk | |
| 2,853,746 | A * | 9/1958 | Spencer | E04B 9/22 411/923 |
| 2,913,104 | A | 11/1959 | Parker | |
| 2,998,337 | A | 8/1961 | Tillotson | |
| 3,231,944 | A | 2/1966 | Bennett | |
| 3,264,165 | A | 8/1966 | Stickel | |
| 3,436,883 | A | 4/1969 | Charman, Jr. et al. | |
| 3,523,395 | A | 8/1970 | Konrad et al. | |
| 3,729,879 | A | 5/1973 | Franklin | |
| 4,003,175 | A | 1/1977 | Patry et al. | |

(Continued)

OTHER PUBLICATIONS

Johns Manville, Installation Instructions for Fiber Glass Batts and Rolls, 2014, http://pdf.lowes.com/energyguides/031979116393.pdf (last accessed on Dec. 12, 2018) (Year: 2014).*

(Continued)

*Primary Examiner* — Theodore V Adamos
(74) *Attorney, Agent, or Firm* — Barnes & Thornburg LLP

(57) ABSTRACT

An insulated surface may include a deck. The insulated surface may further include insulative material coupled to the deck.

18 Claims, 9 Drawing Sheets

(56) References Cited

U.S. PATENT DOCUMENTS 4,041,598 A 8/1977 D Angelo et al.
4,150,465 A 4/1979 Gavin, Jr. et al.
4,290,250 A 9/1981 Kusenda
4,328,652 A 5/1982 Naumovich
4,385,477 A 5/1983 Walls et al.
4,437,282 A * 3/1984 O'Brien ..... E04B 1/7666 248/217.2
4,512,130 A * 4/1985 Pepin ..... E04B 1/7666 411/466
4,569,174 A * 2/1986 Bossany ..... E04B 1/767 52/406.1
4,573,298 A 3/1986 Harkins
4,606,168 A * 8/1986 Fuhrer ..... E04F 13/045 52/410
4,731,917 A 3/1988 Krowl
4,952,441 A * 8/1990 Bose ..... B32B 27/12 428/121
5,331,787 A * 7/1994 Paulitschke ..... E04B 1/7654 206/321
5,389,167 A 2/1995 Sperber et al.
5,421,133 A * 6/1995 Berdan, II ..... E04B 1/767 156/71
5,421,922 A 6/1995 Sperber
5,524,406 A 6/1996 Ragland
5,545,453 A * 8/1996 Grant ..... D04H 3/02 428/43
5,617,687 A 4/1997 Bussey, Jr. et al.
5,750,225 A 5/1998 Petty
5,759,670 A 6/1998 Bussey, Jr. et al.
5,765,318 A 6/1998 Michelsen
5,766,721 A 6/1998 Bussey, Jr. et al.
5,785,478 A 7/1998 Rotter et al.
5,811,167 A 9/1998 Norvell
5,848,509 A 12/1998 Knapp et al.
5,987,833 A * 11/1999 Heffelfinger ..... E04B 1/767 383/211
6,042,911 A * 3/2000 Berdan, II ..... B29C 70/00 156/71
6,083,603 A 7/2000 Patel et al.
6,128,879 A 10/2000 Bussey, Jr. et al.
6,128,884 A * 10/2000 Berdan, II ..... E04B 1/767 52/406.2
6,141,930 A 11/2000 Allwein et al.
6,557,313 B1 * 5/2003 Alderman ..... B32B 7/02 52/407.2
6,579,586 B1 6/2003 Fay et al.
6,673,177 B2 1/2004 Buckwalter et al.
6,790,500 B2 9/2004 Groft et al.
6,860,082 B1 3/2005 Yamamoto et al.
6,901,711 B2 6/2005 Fay et al.
7,381,456 B2 6/2008 Fay et al.
7,544,267 B2 6/2009 Suda et al.
7,858,174 B2 12/2010 Ehrman et al.
7,921,619 B2 4/2011 Snyder et al.
8,307,598 B2 11/2012 Holm et al.
8,956,097 B2 2/2015 Albrecht
9,180,645 B2 11/2015 Fellinger
9,234,355 B2 1/2016 Sealock et al.
2002/0121069 A1 9/2002 Smeja et al.
2003/0070378 A1 * 4/2003 Knapp ..... E04B 1/767 52/483.1
2004/0163345 A1 8/2004 Alderman
2004/0244335 A1 * 12/2004 Babbitt ..... B32B 5/02 52/796.1
2005/0279050 A1 12/2005 Romes
2007/0094966 A1 * 5/2007 Snyder ..... E04D 13/1625 52/309.1
2008/0163565 A1 7/2008 Toas
2010/0065206 A1 3/2010 Romes
2010/0325999 A1 * 12/2010 Devalapura ..... E04B 1/7654 52/506.05
2015/0218803 A1 * 8/2015 Rockwell ..... E04D 13/1637 52/404.2
2016/0083958 A1 * 3/2016 Dowd ..... E04D 13/1625 52/404.3
2017/0234005 A1 8/2017 Yuasa

OTHER PUBLICATIONS

Bailes, Allison, In or Out? Where does the Paper Facing of Batt Insulation Go?, Feb. 14, 2013, https://www.energyvanguard.com/blog/57644/In-or-Out-Where-Does-the-Paper-Facing-of-Batt-Insulation-Go (last accessed on 12/12/2108) (Year: 2013).*

Knauf Insulation GmbH, Knauf Installation Instructions, Bi—Cl—3, Dec. 2005 (retrieved from http://www.eaglerocksupply.com/application/files/9914/4890/6046/Knauf_Insulation_Installation_Instructions.pdf [last accessed on Mar. 26, 2019]) (Year: 2005).*

Owens Corning, AttiCat Attic Installation Instructions, https://www.youtube.com/watch?v=QhL7i68Ns1l, (Oct. 9, 2014) [online video, see segment between 12:00 and 12:49, screenshot included] (Year: 2014).*

Building America Solution Center, Air Sealing Attic Access Panels/Doors/Stairs, Description section, Updated Apr. 1, 2016 [retrieved from https://web.archive.org/web/20161225043411/https://basc.pnnl.gov/resource-guides/air-sealing-attic-access-panelsdoorsstairs#quicktabs-guides=1] (Year: 2016).*

PCT International Search Report and Written Opinion completed by the ISA/US dated Sep. 19, 2017 and issued in connection with PCT/US2017/040922.

* cited by examiner

INSULATIVE MATERIAL AND METHOD FOR INSTALLATION

CROSS REFERENCE TO RELATED APPLICATIONS

This application claims priority to and the benefit of U.S. Provisional Patent Application No. 62/448,690, filed 20 Jan. 2017, and U.S. Provisional Patent Application No. 62/359,535, filed 7 Jul. 2016, the disclosures of which are expressly incorporated herein by reference.

FIELD OF THE DISCLOSURE

The present disclosure relates generally to insulative material and more specifically to installing insulative material to a surface of a structure.

BACKGROUND

Insulating buildings can lower the cost to heat or cool the interior of the building. Along with exterior walls, other structures such as ceilings and floors may also be insulated. Insulating these structures can be achieved with, for example, spray urethane foam insulative materials or fiber insulative materials.

To achieve a desired insulative material rating for such a ceiling, some methods use a spray foam insulative material that may be more expensive than fiber insulative materials. Unfortunately, high R-value batt or roll insulative material is generally too thick to fit within the framing members of the ceiling to achieve a comparable R-value to the applied spray foam insulative material. Moreover, since most roof trusses are constructed out of 2×4's or 2×6's and typical insulative material in attic area is 6 inches to 12 inches thick, installing batt or roll insulative material in the trusses may be labor intensive and may require techniques that compress portions of the insulative material that therefore decrease the R-value.

SUMMARY

The present disclosure may comprise one or more of the following features and combinations thereof.

A method of insulating a first cavity formed in a ceiling between a first framing member, a second framing member, and a deck may include providing insulative material, locating the insulative material in the first cavity formed in the ceiling, and fastening together the insulative material and the deck with a fastener.

In some embodiments, the insulative material includes a backing layer, an insulative-fiber layer, and an adhesive layer extending between and interconnecting the backing layer and the insulative-fiber layer. In some embodiments, the step of locating includes orienting the insulative material so that the backing layer is located between the deck and the insulative-fiber layer. In some embodiments, the fastener extends from the insulative-fiber layer through the backing layer into the deck.

In some embodiments, the fastener is a staple and includes a first leg, a second leg spaced apart from the first leg, and a crown extending between the first leg and the second leg. In some embodiments, a portion of the insulative-fiber layer is located between the crown and the backing layer.

In some embodiments, the insulative-fiber layer is rock wool.

In some embodiments, the method may further include heating the adhesive layer and coupling the insulative-fiber layer to the adhesive layer to form the insulative material.

In some embodiments, the ceiling may further comprise a third framing member located spaced-apart from the first framing member to locate the second framing member therebetween. In some embodiments, the third framing member, the second framing member, and the deck cooperate to form a second cavity therein. In some embodiments, the method may further comprise locating insulative material in the second cavity and fastening the insulative material in the second cavity to the deck with a second fastener. In some embodiments, when both the first cavity and the second cavity contain insulative material, a portion of the second framing member located between the first cavity and the second cavity is not visible when the ceiling is viewed from below.

In some embodiments, the backing layer is reinforced. In some embodiments, each of the first and second framing members extends away from the deck a first distance and the insulative material extends away from the deck a second distance that is generally greater than the first distance.

In some embodiments, the insulative material is a portion of a roll of insulative material. In some embodiments, the insulative material is a batt of insulative material.

In some embodiments, the ceiling is located in an attic. In some embodiments, the ceiling is located in a crawl space.

In some embodiments, the ceiling is a cathedral ceiling. In some other embodiments, the ceiling is generally horizontal relative to a ground surface.

According to another aspect of the present disclosure, an insulated ceiling may include a ceiling, insulative material, and a fastener. The ceiling includes a deck, a first framing member, and a second framing member located spaced-apart from the first framing member. In some embodiments, the deck, the first framing member, and the second framing member cooperate to form a first cavity therein. The insulative material may extend between the first framing member and the second framing member. The insulative material may include a backing layer arranged to face the deck, an insulative-fiber layer arranged to face away from the deck, and an adhesive layer extending between and interconnecting the backing layer and the insulative-fiber layer. The fastener may extend from the insulative-fiber layer through the backing layer into the deck.

In some embodiments, the first and second framing members extend away from the deck a first distance and the insulative material extends away from the deck a second distance that is generally greater than the first distance.

In some embodiments, the insulative material is about 10 inches thick. In some other embodiments, the insulative material is about 12 inches thick.

In some embodiments, each of the first framing member and the second framing member extends away from the deck up to about 4 inches.

In some embodiments, a portion of the insulative-fiber layer is located between the fastener and the deck. In some embodiments, a portion of the backing layer is located between the portion of the insulative-fiber layer and the deck.

In some embodiments, the fastener is a staple and includes a first leg, a second leg spaced apart from the first leg, and a crown extending between the first leg and the second leg. In some embodiments, each of the first leg and second leg extends through the insulative-fiber layer and the backing layer into the deck. In some embodiments, the crown locates the portion of the backing layer between the insulative-fiber layer and the deck.

According to another aspect of the present disclosure, method of installing insulative material may include locating insulative material including a backing layer, an insulative-fiber layer, and an adhesive layer extending between and interconnecting the backing layer and the insulative-fiber layer on a surface, and fastening together the insulative material and the surface with a fastener so that the fastener extends from the insulative-fiber layer through the backing layer to the surface to locate the backing layer between the insulative-fiber layer and the surface.

In some embodiments, the surface includes a first framing member, a second framing member, and a deck that cooperate to form a cavity to locate the insulative material therein.

In some embodiments, the surface is generally vertical relative to a floor. In some embodiments, the surface is a ceiling and is generally horizontal relative to a floor.

In some embodiments, the step of fastening is performed with a pneumatic staple gun. In some embodiments, the fastener is a staple.

In some embodiments, the insulative material is fastened to the surface. In some embodiments, the insulative material does not permanently deform visually after it is fastened to the surface.

According to another aspect of the present disclosure, an insulative material comprises an insulative-fiber layer, a backing layer, and an adhesive layer. In some embodiments, the adhesive layer extends between and interconnects the insulative-fiber layer and the backing layer.

In some embodiments, the backing layer is permeable. In some embodiments, the backing layer is formed to include a plurality of vent apertures. In some embodiments, the backing layer comprises a material that is permeable to vapor.

In some embodiments, the adhesive layer comprises a plurality of adhesive strips.

In some embodiments, the backing layer has a width that is generally narrower than the width of the insulative-fiber layer. In some embodiments, the backing layer and the adhesive layer are formed to include vent apertures that extend from the backing layer through the adhesive layer and open into the insulative-fiber layer.

In some embodiments, the backing layer includes an outer-backing layer, a reinforcement layer, and an inner-backing layer.

According to another aspect of the present disclosure, a method of insulating a surface comprising a deck, may include locating insulative material comprising a backing layer and an insulative-fiber layer coupled with the backing layer on the surface so that the backing layer is located between the insulative-fiber layer and the deck, and fastening together the insulative material and the deck with a fastener.

In some embodiments, the fastener extends from the insulative-fiber layer through the backing layer into the deck. In some embodiments, the fastener is a staple and includes a first leg, a second leg located in spaced-apart relation to the first leg, and a crown extending between the first leg and the second leg.

In some embodiments, a portion of the insulative-fiber layer is located between the crown and the backing layer. In some embodiments, the portion of the insulative-fiber layer that is located between the crown and the backing layer has a density that is greater than a density of a portion of the insulative-fiber layer that is not located between the crown and the backing layer.

In some embodiments, some fibers of the insulative-fiber layer are fractured by the fastener during the step of fastening.

In some embodiments, the insulative material includes the backing layer, the insulative-fiber layer located in spaced-apart relation to the backing layer, and an adhesive layer extending between and interconnecting the backing layer and the insulative-fiber layer. In some embodiments, the insulative-fiber layer has a width and the backing layer has a width that is generally less than or equal to the width of the insulative-fiber layer.

In some embodiments, the backing layer is formed to include vent apertures that extend through the backing layer and open into the deck and are located between the at least two adhesive strips. In some other embodiments, the backing layer is non-permeable.

In some embodiments, the surface includes a first framing member and a second framing member that cooperate with the deck to form a cavity that is sized to receive the insulative material. In some illustrative embodiments, each of the first and second framing members extends away from the deck a first distance and the insulative material extends away from the deck a second distance that is generally greater than the first distance. In some embodiments, the cavity has a width that is generally less than or equal to the width of the insulative-fiber layer.

According to another aspect of the present disclosure, an insulated ceiling may comprise a ceiling, insulative material, and a fastener. In some embodiments, the ceiling comprises a deck, a first framing member, and a second framing member. In some embodiments, the first framing member is spaced apart from the second framing member. In some embodiments, the deck, the first framing member, and the second framing member cooperate to form a first cavity therebetween. In some embodiments, the ceiling has an insulation rating of at least R-8, at least R-13, or at least R-19.

In some illustrative embodiments, the insulative material extends between the first framing member and the second framing member. In some embodiments, the insulative material includes a backing layer arranged to face the deck, an insulative-fiber layer spaced-apart from the backing layer to locate the backing layer between the insulative-fiber layer and the deck, and an adhesive layer extending between and interconnecting the backing layer and the insulative-fiber layer.

In some illustrative embodiments, the fastener extends from the insulative-fiber layer through the backing layer into the deck.

In some embodiments, the first and second framing members extend away from the deck a first distance and the insulative material extends away from the deck a second distance that is generally greater than the first distance. In some embodiments, the insulative material extends over the first and second framing members to form a generally continuous and uninterrupted surface.

In some embodiments, a portion of the insulative-fiber layer is located between the fastener and the deck so that the portion of the insulative-fiber layer that is located between the fastener and the deck has a density that is greater than a density of a portion of the insulative-fiber layer that is not located between the fastener and the deck.

According to another aspect of the present disclosure, an insulative material may comprise an insulative-fiber layer, a backing layer, and an adhesive layer. In some embodiments, the insulative-fiber layer has a width. In some embodiments, the backing layer has a width that is generally narrower than the width of the insulative-fiber layer. In some embodiments, the adhesive layer extends between and interconnects the insulative-fiber layer and the backing layer. In some embodiments, the backing layer is non-permeable.

These and other features of the present disclosure will become more apparent from the following description of the illustrative embodiments.

DETAILED DESCRIPTION OF THE DRAWINGS

Figure 1:
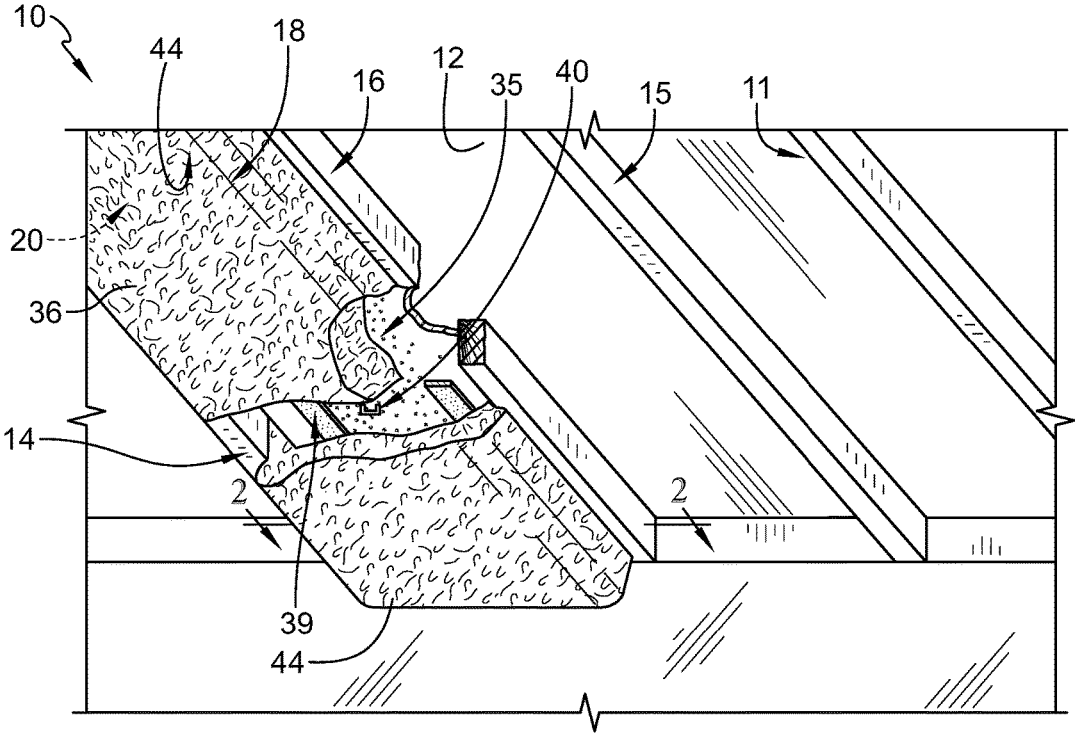
FIG. 1 is a perspective view of a ceiling including a plurality of framing members spaced apart from one another along a deck to form a cavity therebetween, and further showing a portion of a framing member cut away to show insulative material in the cavity.

For the purposes of promoting an understanding of the principles of the disclosure, reference will now be made to a number of illustrative embodiments illustrated in the drawings and specific language will be used to describe the same.

Figure 2:
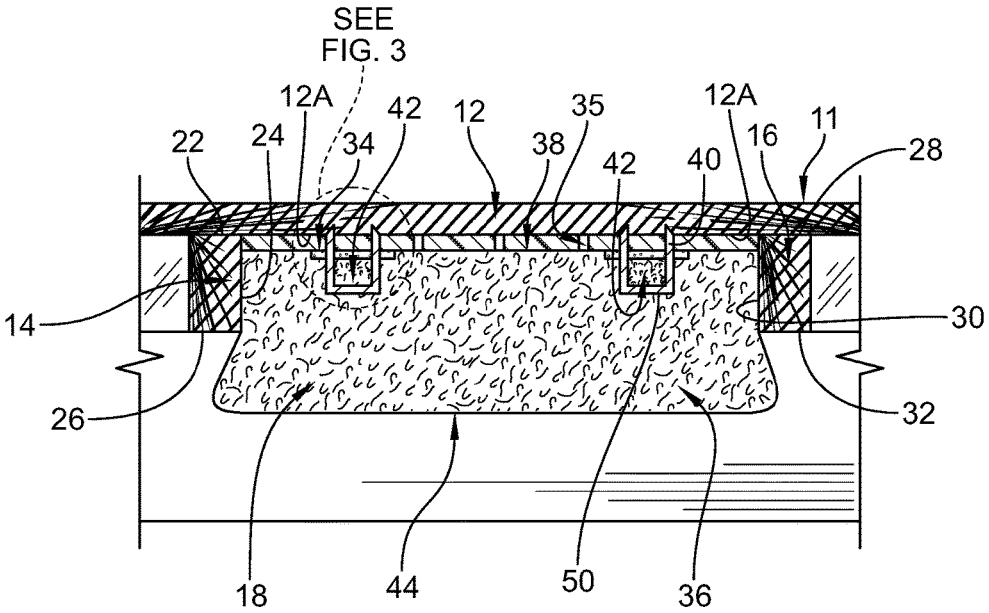
FIG. 2 is a sectional view taken along line 2-2 of FIG. 1 showing from top to bottom the deck, a first framing member and a second framing member located in spaced-apart relation to the first framing member, and the insulative material located in the cavity between the first framing member and the second framing member, and further showing the insulative material includes from top to bottom a backing layer, an adhesive layer, and an insulative-fiber layer and that the insulative material is fastened to the deck with a fastener.
Figure 3:
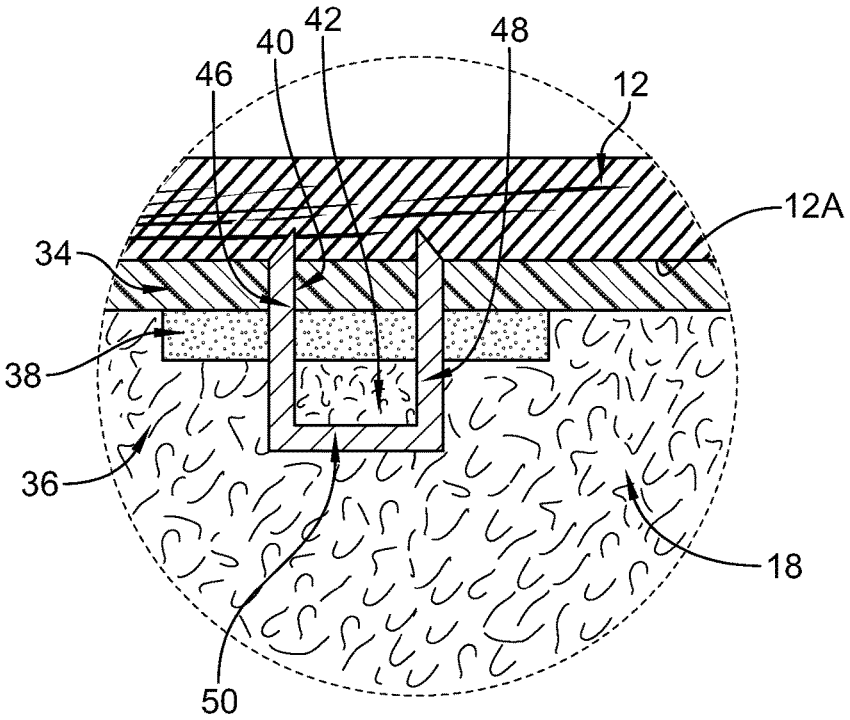
FIG. 3 is a detail view of a portion of the insulated ceiling of FIG. 2, showing a fastener extending from the insulative-fiber layer through the adhesive layer and the backing layer into the deck so that a portion of the insulative-fiber layer and a portion of the backing layer are located between the fastener and the deck.
Figure 14:
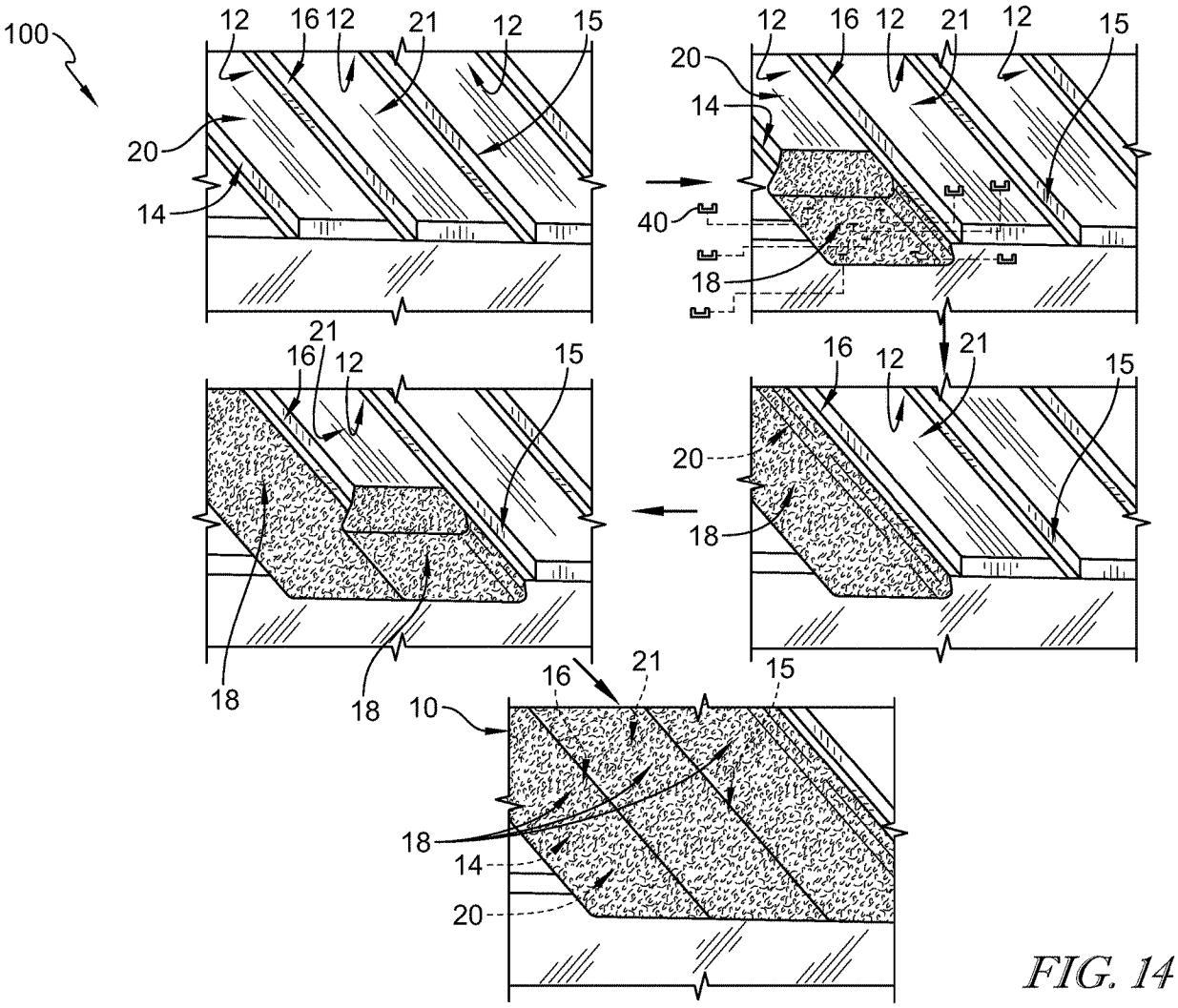
FIG. 14 is a diagrammatic view of a method of installing insulative material on a surface.

Insulating a surface 11, such as a ceiling 11, in an attic may allow for increased attic space while still providing a desired insulative value to the attic. As described in illustrative embodiments herein, an insulated ceiling 10, includes the surface 11 and insulative material 18 coupled to the surface 11, as shown in FIGS. 1-3. The insulative material 18 comprises an insulative-fiber layer 36 that extends away from the surface 11 and is configured to provide an insulative value. In illustrative embodiments, the insulative-fiber layer 36 is exposed when viewing the surface 11, as shown for example in FIGS. 1-3. Illustratively, the insulative-fiber layer 36 retains its approximate insulative value and approximate thickness when installed, for example, using method 100, as shown in FIG. 14. Illustratively, the insulated ceiling 10 can be a cathedral ceiling 10, an attic ceiling 10, or a crawl space ceiling 10, although the embodiments described herein can be applicable to a wide range of horizontal or vertical structures.

In some illustrative embodiments, the insulative material 18 is coupled together with surface 11 with a fastener 40, as shown in FIGS. 1-3. The fastener 40 may be a staple 40, as shown in FIGS. 1-3, or any other suitable fastener. The fastener extends through the insulative-fiber layer and into the deck 12, as shown in FIG. 2. In some embodiments, the insulative material 18 may be coupled to the surface 11 with an adhesive or other suitable means such as wires or brackets.

The insulative material 18 includes a backing layer 34, the insulative-fiber layer 36, and an adhesive layer 38, as shown in FIGS. 1-5. The adhesive layer 38 extends between and interconnects the backing layer 34 and the insulative-fiber layer 36. The insulative material 18 is arranged so that the backing layer 34 is located between a deck 12 of the surface 11 and the insulative-fiber layer, as shown in FIGS. 1-3. In some embodiments, the insulative material 18 does not include an adhesive layer, a backing layer, or an adhesive layer and a backing layer. Illustratively, in some embodiments where the insulative material 18 does not include a backing layer or an adhesive layer, the insulative-fiber layer 36 directly contacts the deck 12.

The surface 11 includes the deck 12, a first framing member 14, and a second framing member 16, as shown in FIGS. 1 and 2. The deck 12 is arranged to overlie the first and second framing members 14, 16 and includes an inward face 12A that faces the first framing member 14 and a second framing member 16. The first framing member 14 is located in spaced-apart relation to the second framing member 16. The deck 12 cooperates with the first framing member 14 and the second framing member 16 to form a cavity 20 sized to receive the insulative material 18. Illustratively, the framing members 14, 16 may be referred to as a roof truss or a stud. In some embodiments, the surface 11 does not have the framing members 14, 16 so that two pieces of insulative material 18 lie adjacent one another.

Figure 4:
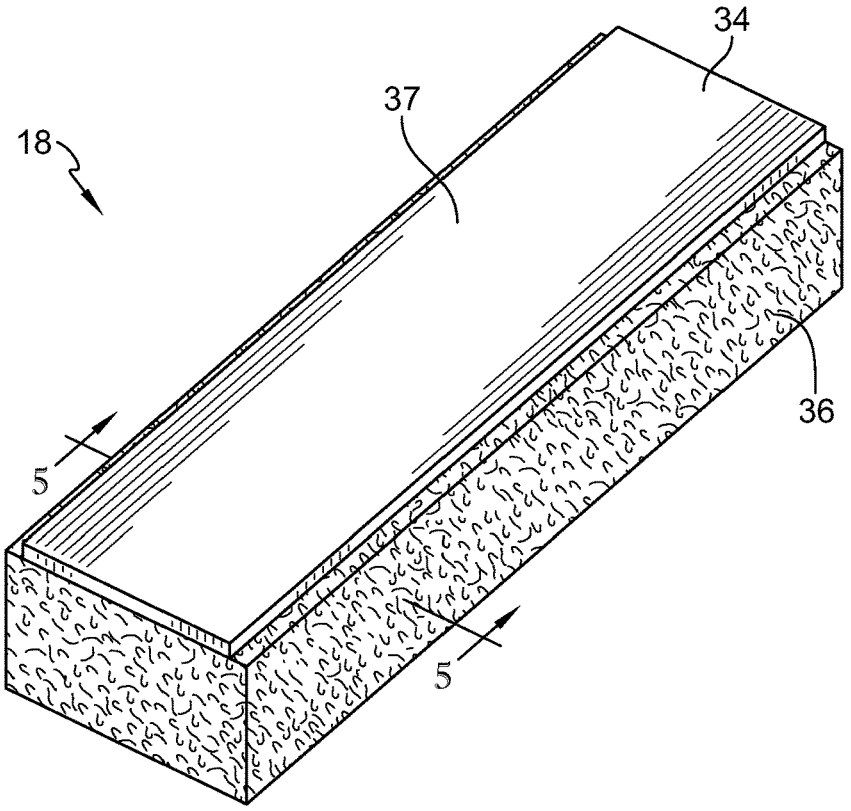
FIG. 4 is a perspective view of a batt of insulative material used for forming the insulated ceiling.

The insulative material 18 may be in the form of a batt, as shown in FIG. 4, or a portion of a roll of insulative material 18 that has been cut to size. The insulative material 18 is sized to extend over the first and second framing members 14, 16 so that the insulated surface 10 may act as a thermal block. Each of the first framing member 14 and the second framing member 16 extends away from the inward face 12A of the deck 12 a distance D1 as shown in FIGS. 1 and 2. In some embodiments, the distance D1 is about 2 to about 6 inches. In some embodiments, the framing members 14, 16 are 2×4s and D1 is about 3.5 inches. In some embodiments, the framing members 14, 16 are 2×6s and D1 is about 5.5 inches.

In an illustrative embodiment, the first framing member 14 is generally parallel with second framing member 16, as shown in FIG. 1. The first framing member 14 includes a first face 22, a second face 24, and a third face 26 as shown in FIG. 2. The first face 22 of first framing member 14 faces the deck 12. The second face 24 of first framing member 14 faces the second framing member 16. The third face 26 of first framing member 14 faces away from the deck 12. The second framing member 16 includes a first face 28, a second face 30, and a third face 32 as shown in FIG. 2. The first face 28 of second framing member 16 faces the deck 12. The second face 30 of second framing member 16 faces the first framing member 14. The third face 32 of second framing member 16 faces away from the deck 12. The second face 24 of first framing member 14, the second face 30 of second framing member 16 and the inward face 12A of the deck 12 cooperate to define the cavity 20.

The cavity 20 has a width W1 that is defined by the distance between the second face 24 of the first framing member 14 and the second face 30 of the second framing member 16. The insulative material 18 is sized to extend between the second face 24 of the first framing member 14 and the second face 30 of the second framing member 16 and within the cavity 20, as shown in FIG. 2. In some illustrative embodiments, when the insulative material 18 is installed to form the insulated ceiling 10, the third faces 26, 32 of the framing members 14, 16 may not be visible when the insulated ceiling 10 is viewed from below.

The insulative material 18 extends away from the inward face 12A of the deck 12 a distance D2 as shown in FIG. 2. In some embodiments, the distance D2 the insulative material 18 extends away from the inward face 12A of the deck 12 is greater than the distance D1. In some embodiments, insulative material 18 can be selected so that D2 is about 1 inch, about 2 inches, about 3 inches, about 4 inches, about 5 inches, about 6 inches, about 7 inches, about 8 inches, about 9 inches, about 10 inches, about 11 inches, about 12 inches, about 13 inches, about 14 inches, about 15 inches, about 16 inches, about 17 inches, about 18 inches, about 19 inches, about 20 inches, or about 24 inches. In some embodiments, the insulative material 18 can be selected so that D2 is in a range of about 1 inch to about 24 inches, about 1 inch to about 20 inches, about 4 inches to about 20 inches, about 4 inches to about 18 inches, about 8 inches to about 18 inches, or about 8 inches to about 12 inches.

The insulative material 18 may be rated from about R-3 to about R-38, according to ASTM C518. The rating may be about R-3, about R-5, about R-8, about R-11, about R-13, about R-15, about R-19, about R-21, about R-30, about R-38, about R-49, or about R-60. In some embodiments, the insulative material 18 may be rated about R-19. In some embodiments, the insulative material 18 may be rated about R-38. In some embodiments, the insulative material 18 is rated at least R-8, at least R-13, or at least R-19. In some embodiments, the insulative material 18 is rated about R-5 to about R-49, about R-13 to about R-49, or about R-19 to about R-45.

The adhesive layer 38 extends between and interconnects the insulative-fiber layer 36 and the backing layer 34. In some embodiments, the adhesive layer 38 comprises an asphalt adhesive or any suitable alternative. In some embodiments, the adhesive layer 38 comprises a hot melt, a wax, a combination thereof, or any suitable alternative. In some embodiments, the adhesive layer 38 acts as a vapor barrier or a vapor retarder.

The adhesive layer 38 comprises a plurality of, or at least two, adhesive strips 39, as shown in FIGS. 1-3. The adhesive strips 39 can be equally spaced and expose areas of the backing layer 34 to the insulative-fiber layer 36. Illustratively, if the backing layer 34 is permeable or the backing layer 34 is formed to include the vent apertures 35, the sections of the backing layer 34 that are not covered with an adhesive strip 39 may allow vapor transfer between the deck 12 and the insulative-fiber layer 36. The adhesive strips 39 may be generally parallel with one another, generally parallel with the framing members 14, 16, or both.

The backing layer 34 is configured to provide sufficient strength and tear resistance so the insulative material 18 is retained on the deck 12. In some embodiments, the backing layer 34 comprises a reinforcing material. In some embodiments, the reinforcing material comprises fiberglass, a scrim mat, or any other suitable alternative.

When the insulative material 18 is coupled to the deck 12, the backing layer 34 is located between the insulative-fiber layer 36 and the deck 12 as shown in FIGS. 1-3. The backing layer 34 may comprise a polyethylene, a polypropylene, a polyamide, a combination thereof, or any suitable alternative. In some embodiments, the backing layer 34 comprises a metallized foil. In some embodiments, the backing layer 34 may comprise a foil-scrim-kraft material. In some embodiments, the backing layer 34 may comprise a polypropylene-scrim-kraft material. In some embodiments, the backing layer 34 may comprise a mat face material, a mesh material, or a scrim mat. In some embodiments, the insulative material 18 does not have a backing layer and the insulative-fiber layer 36 lies adjacent and directly contacts the deck 12.

Figure 5:
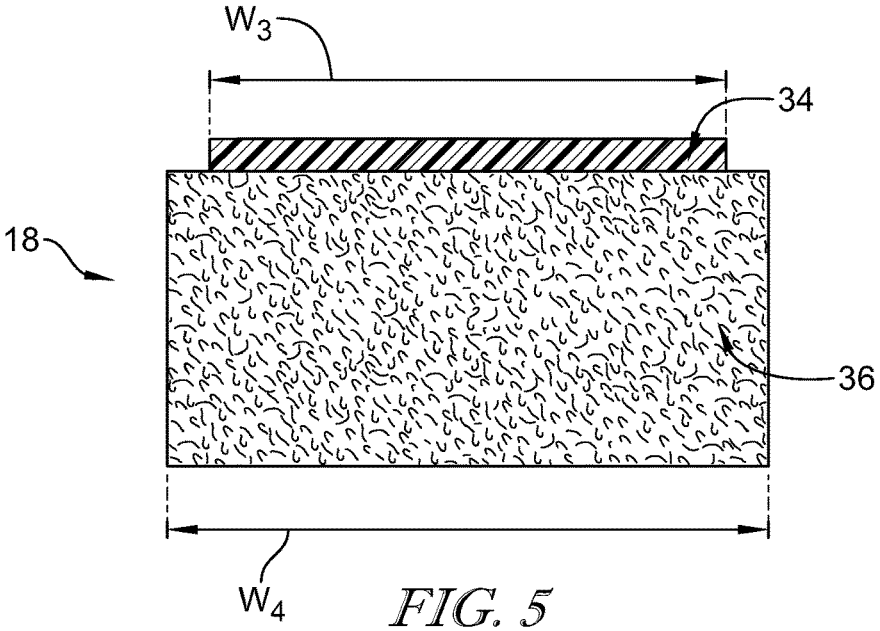
FIG. 5 is a sectional view taken along line 5-5 of FIG. 4 showing the backing layer has a width that is generally less than a width of the insulative-fiber layer.
Figure 6:
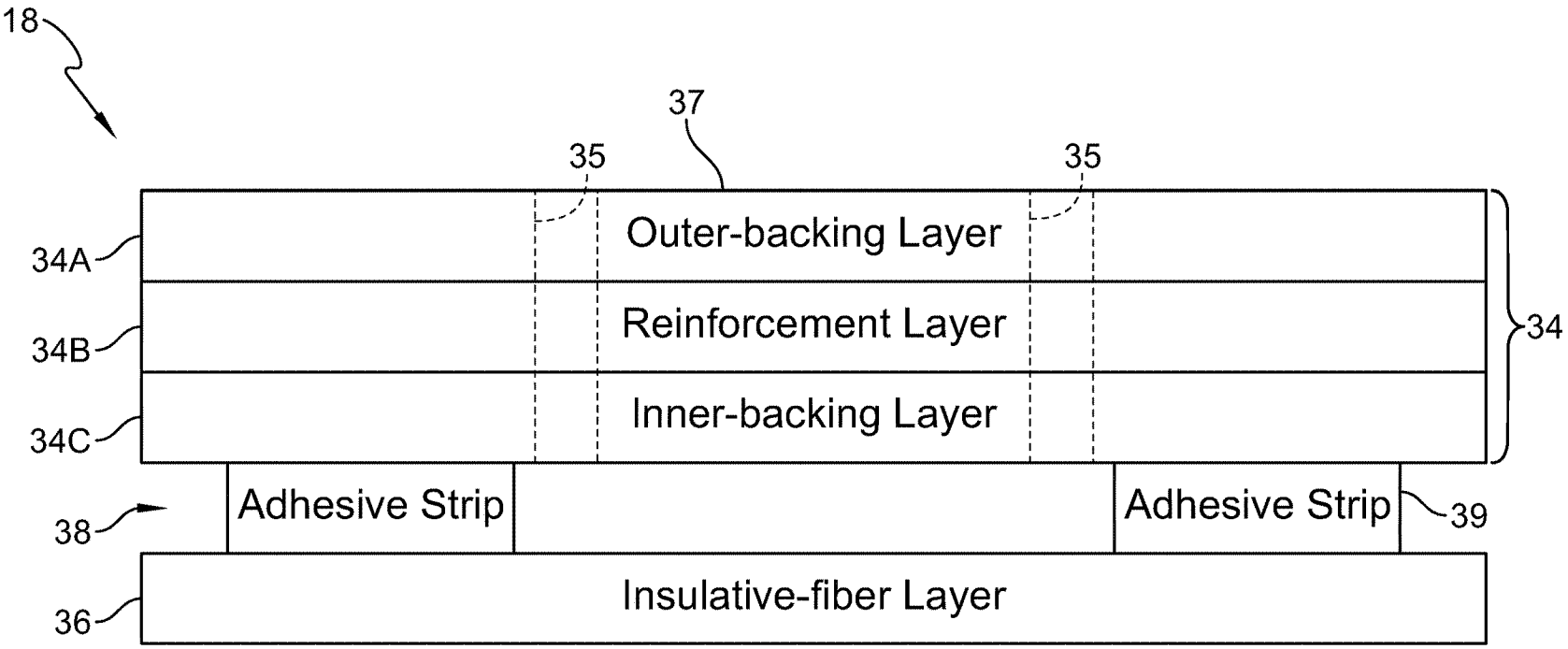
FIG. 6 is a diagrammatic view of the insulative material from FIGS. 1-5, showing the backing layer includes from top-to-bottom an outer-backing layer, a reinforcement layer, and an inner-backing layer, and further showing the vent apertures extending through the backing layer to open into the insulative-fiber layer.

In some embodiments, the backing layer 34 has a width W2 that is generally narrower than the width W3 of the insulative-fiber layer 36, as shown in FIGS. 4-6. The width W2 of backing layer 34 can be sized to extend between the second face 24 of the first framing member 14 and the second face 30 of the second framing member 16, as shown in FIGS. 1 and 2. In some embodiments, the width W2 is about the same as the width W1 of the cavity 20. In some embodiments, the width W2 is less than the width W1. In some embodiments, the width W2 can be about 21 inches, about 22 inches, or about 22.5 inches. In some embodiments, the width W3 is about the same as the width between the centers of the third face 26 of the first framing member 14 and the third face 32 of the second framing member 16. In some embodiments, the width W3 is about 24 inches.

In some embodiments, the backing layer 34 may act as a vapor retarder and retard the flow of vapor from the deck 12 to the insulative-fiber layer 36. In some embodiments, the backing layer 34 may be permeable and allow the transmission of vapor therethrough. Illustratively, the backing layer 34 may comprise a material that is permeable, be formed to include vent apertures 35, expose areas of the insulative-fiber layer 36, a combination thereof, or any suitable alternative. Illustratively, the backing layer 34 may comprise a membrane that is permeable to moisture. An exemplary embodiment of a permeable backing layer 34 is MemBrain™ produced by CertainTeed®. In some embodiments, the backing layer 34 comprises a kraft paper.

In some embodiments, the backing layer 34 includes an outer-backing layer 34A, a reinforcement layer 34B, and an inner-backing layer 34C, as shown in FIG. 6. The outer-backing layer 34A is arranged to form outer surface 37 of the backing layer 34. The reinforcement layer 34B extends between and interconnects the outer-backing layer 34A and the inner-backing layer 34C. The inner-backing layer 34C extends between and interconnects the reinforcement layer 34B and the adhesive layer 38.

The backing layer 34 can be formed to include vent apertures 35, as shown in dashed line in FIG. 6. In some embodiments, the vent apertures 35 extend through the backing layer 34 and open into the adhesive layer 38. In some embodiments, the vent apertures 35 extend from the outer-backing layer 35A through the adhesive layer 38 and open into the insulative-fiber layer 36. The vent apertures 35 that open into the insulative-fiber layer 36 may be used to allow vapor transfer between the deck 12 and the insulative material 18.

The outer-backing layer 34A is arranged to form outer surface 37 of the backing layer 34, as shown in FIG. 6. In an illustrative embodiment, the outer-backing layer 34A comprises a metallized foil, a paper, a kraft paper, a membrane, a plastic a combination thereof, or any suitable alternative. Illustrative plastics include a polyethylene, a polypropylene, a polyamide, a combination thereof, or any suitable alternative. The outer-backing layer 34A is arranged to lie adjacent and/or directly contact the deck 12 when the insulative material 18 is coupled with the surface 11.

The reinforcement layer 34B extends between and interconnects the outer-backing layer 34A and the inner-backing layer 34C, as shown in FIG. 6. The reinforcement layer 34B is configured to provide strength to the backing layer 34. In some embodiments, the reinforcement layer 34B is configured to receive a portion of the fastener 40 therethrough to secure the insulative material 18 to the deck 12. Illustratively, the reinforcement layer 34B comprises a scrim type material comprising fibers. Without being bound by theory, locating a portion of a fiber of the reinforcement layer 34B between a crown 50 of the fastener 40 and the deck 12 may help secure the insulative material 18 to the deck 12.

The inner-backing layer 34C extends between and interconnects the reinforcement layer 34B and the adhesive layer 38, as shown in FIG. 6. In some embodiments, the inner-backing layer 34C comprises a metallized foil, a paper, a kraft paper, a membrane, a plastic a combination thereof, or any suitable alternative. Illustrative plastics include a polyethylene, a polypropylene, a polyamide, a combination thereof, or any suitable alternative.

The insulative-fiber layer 36 is coupled to the adhesive layer 38 and extends away from the deck 12 as shown in FIGS. 1-4. In some embodiments, the insulative-fiber layer 36 comprises a glass mineral wool fiber or any suitable alternative. In some embodiments, the insulative-fiber layer 36 comprises rock wool. In some embodiments, the insulative-fiber layer 36 comprises glass wool. In some embodiments, the insulative-fiber layer 36 is a high-density fiber. In some embodiments, the insulative-fiber layer 36 further comprises a binder.

In some embodiments, the insulative-fiber layer 36 will not, or minimally, absorb water vapor. In some embodiments, the insulative-fiber layer 36 absorbs less than 5% by weight water vapor according to ASTM C1104. In some embodiments, the insulative-fiber layer 36 will not sustain mold growth. In some embodiments, the insulative-fiber layer 36 will not support microbial growth according to ASTM C1338.

The insulative material 18 is coupled to the deck 12 with a fastener 40 as shown in FIGS. 1-4. The fastener 40 extends from the insulative-fiber layer 36 through the backing layer 34 to the deck 12. In some embodiments, a portion of the insulative-fiber layer 42 is located between the fastener 40 and the backing layer 34 as shown in FIGS. 2 and 3. Illustratively, the portion of the insulative-fiber layer 42 located between the crown 50 and the deck 12 has a density that is greater than the density of the insulative material 18 that is not located between the crown 50 and the deck 12.

In some embodiments, the fastener 40 is a staple and includes a first leg 46, a second leg 48, and a crown 50, as shown in FIGS. 2 and 3. The first leg 46 and second leg 48 are spaced apart from one another. The crown 50 extends between the first leg 46 and the second leg 48. Illustratively, when the insulative material 18 is coupled to the deck 12 each of the first leg 46 and the second leg 48 extend from the crown 50 through the backing layer 34 into the deck 12. In some embodiments, some fibers of the insulative-fiber layer 36 are fractured by the crown 50 when stapling the insulative material 18 to the deck 12. In some embodiments, the fastener is inserted into the deck 12 on an opposite side of the deck 12 from the insulative material 18.

Illustratively, the crown 50 locates a portion of the backing layer 34 between the deck 12 and the crown 50. The crown 50 has a width as measured from the first leg 46 to the second leg 48. In some embodiments, the crown 50 may be about 0.25 inches wide. In some embodiments, the crown 50 may be about 0.5 inches wide. In some embodiments, the first leg 46 may be about 0.75 inches long. In some embodiments, the fastener 40 is a hammer-set fastener or any suitable alternative. In some embodiments, the crown 50 may be about 0.1 inches wide to about 1 inch wide, about 0.2 inches wide to about 1 inch wide, about 0.3 inches to about 1 inch wide, or about 0.4 inches wide to about 1 inch wide. In some embodiments, the crown 50 extends away about 0.1 inches to about 0.3 inches from the deck 12 after fastening the insulative material 18 to the deck 12.

Illustratively, a first face 44 of the insulative material 18 that faces away from the deck 12 is not deformed visually when the insulative material 18 is fastened to the deck 12. In some embodiments, the fastened insulative material 18 is not appreciably compressed so the performance is maintained. Illustratively, the first face 44 is generally exposed when the insulative material 18 is coupled with the surface 11.

In some embodiments, insulative material 18 is coupled with deck 12 with a plurality of fasteners 40, as suggested in FIGS. 1 and 2. In some embodiments, the insulative material 18 is coupled with the deck 12 with 1, 2, 3, 4, 5, 6, 7, 8, 9, 10, 11, 12, or 13 fasteners or any other number of suitable fasteners. In an illustrative embodiment, about 6 fasteners are used to fasten the insulative material to the deck 12, as shown in FIG. 14. The fasteners 40 may be inserted so that there are two fasteners 40 located at a first end of the batt of insulative material 18, two fasteners 40 at a second end of the batt of insulative material 18, and two fasteners 40 between the first and second ends of the batt of insulative material, as shown in FIG. 14.

Illustratively, the deck 12 may be vertical if the surface 11 is a wall, or the deck 12 may be generally horizontal if the surface 11 is part of a ceiling. In some embodiments, the deck 12 comprises wood or any suitable alternative, as shown in FIGS. 1-3. In some embodiments, the deck 12 comprises metal or any suitable alternative. In other embodiments, the deck 12 comprises concrete. The type of fastener 40 used may depend on the composition of the deck 12. In some exemplary embodiments, the deck 12 is oriented strand board (OSB) material.

Figure 7:
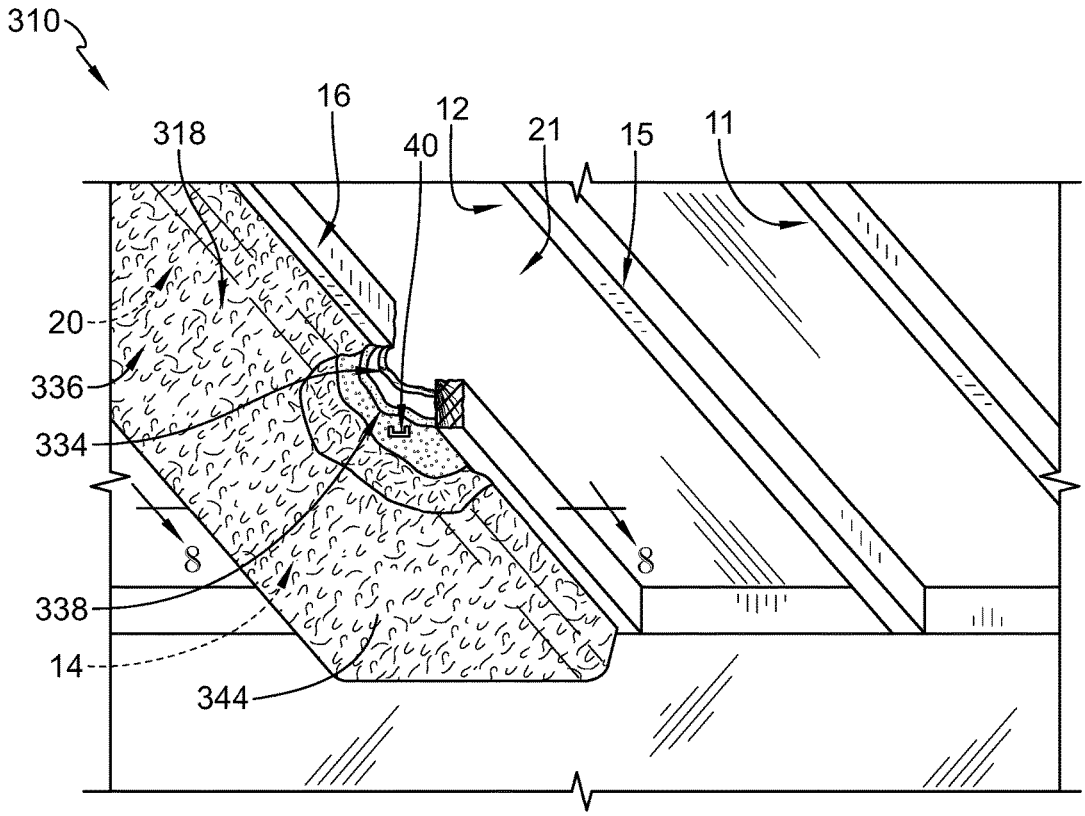
FIG. 7 is another embodiment of an insulated ceiling similar to FIG. 1, showing portions of an insulative-fiber layer broken away to show the adhesive layer between the insulative-fiber layer and a backing layer.

In another embodiment, an insulated ceiling 310 comprises an insulative material 318 coupled to a surface 11, as shown in FIG. 7. The surface 11 of FIG. 7 is similar to the surface 11 of FIG. 1, and the description of the surface 11 of FIG. 1 is incorporated herein for the ceiling 310.

Figure 8:
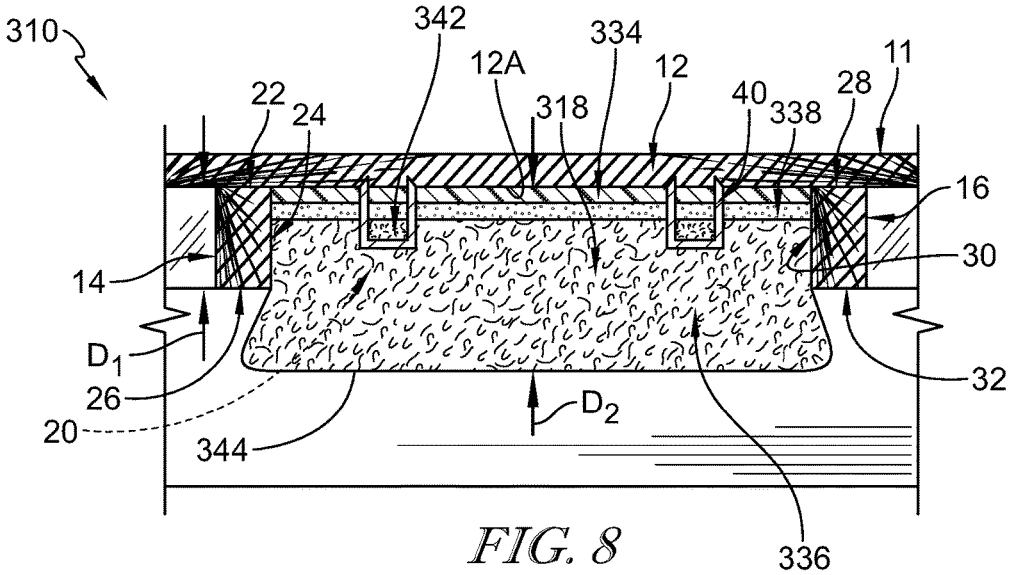
FIG. 8 is a sectional view taken along line 8-8 of FIG. 7, showing the backing layer, the adhesive layer extending between the backing layer and the insulative-fiber layer, and further showing a fastener extending from the insulative fiber layer into a deck of the surface.
Figure 9:
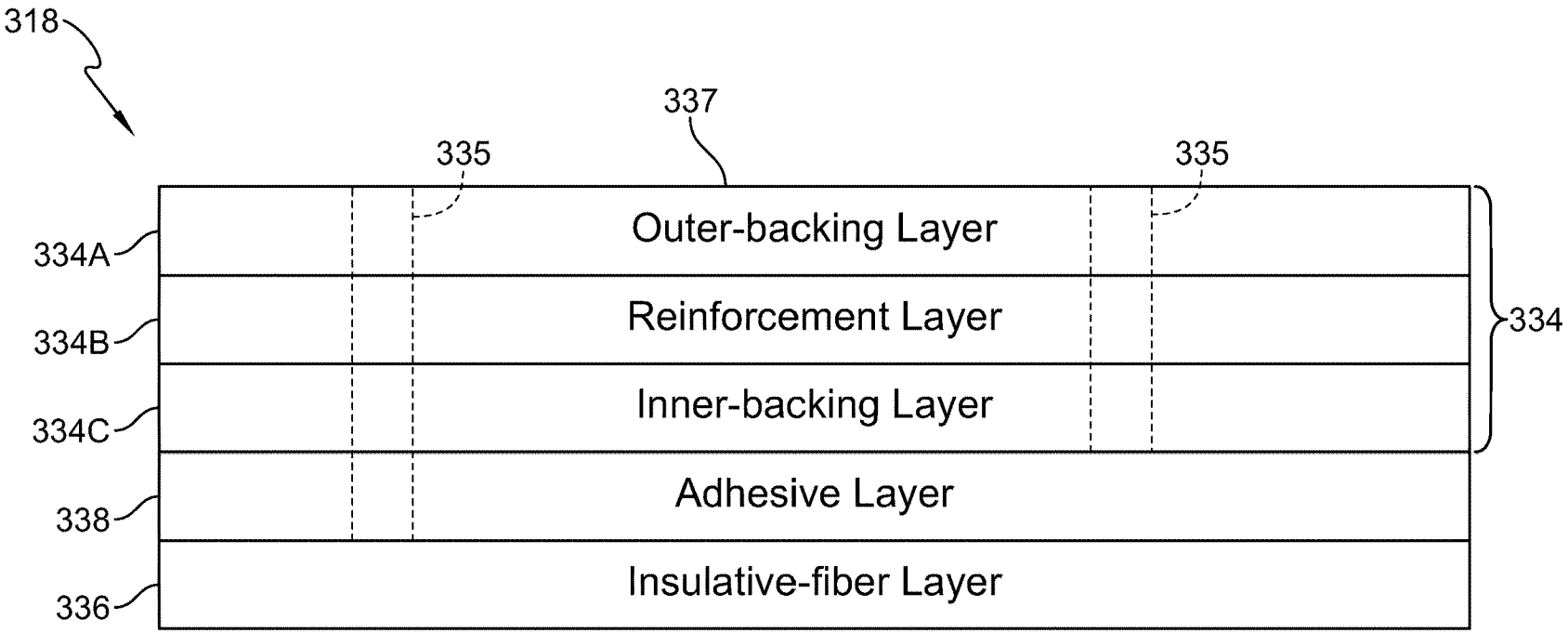
FIG. 9 is a diagrammatic view, similar to FIG. 6, of the insulative material of FIGS. 7-8, showing the optional vent apertures extending through the backing layer or extending through the backing layer and the adhesive layer.

The insulative material 318 includes a backing layer 334, an insulative-fiber layer 336, and an adhesive layer 338, as shown in FIGS. 7-9. The insulative-fiber layer 336 is coupled to the backing layer 334 with the adhesive layer 338. The adhesive layer 38 extends between the backing layer 334 and the insulative-fiber layer 336.

The insulative material 318 may be in the form of a batt or a portion of a roll of insulative material 318 that has been cut to size. The insulative material 318 is sized to extend over the first and second framing members 14, 16 so that the insulated surface 310 may act as a thermal block. Each of the first framing member 14 and the second framing member 16 extends away from the inward face 12A of the deck 12 a distance D1 as shown in FIGS. 7 and 8. In some embodiments, the distance D1 is about 2 to about 6 inches. In some embodiments, the framing members 14, 16 are 2×4s and D1 is about 3.5 inches. In some embodiments, the framing members 14, 16 are 2×6s and D1 is about 5.5 inches.

The insulative material 318 extends away from the inward face 12A of the deck 12 a distance D2 as shown in FIG. 8. In some embodiments, the distance D2 the insulative material 18 extends away from the inward face 12A of the deck 12 is greater than the distance D1. In some embodiments, insulative material 18 can be selected so that D2 is about 1 inch, about 2 inches, about 3 inches, about 4 inches, about 5 inches, about 6 inches, about 7 inches, about 8 inches, about 9 inches, about 10 inches, about 11 inches, about 12 inches, about 13 inches, about 14 inches, about 15 inches, about 16 inches, about 17 inches, about 18 inches, about 19 inches, about 20 inches, or about 24 inches. In some embodiments, the insulative material 318 can be selected so that D2 is in a range of about 1 inch to about 24 inches, about 1 inch to about 20 inches, about 4 inches to about 20 inches, about 4 inches to about 18 inches, about 8 inches to about 18 inches, or about 8 inches to about 12 inches.

The insulative material 318 may be rated from about R-3 to about R-38, according to ASTM C518. The rating may be about R-3, about R-5, about R-8, about R-11, about R-13, about R-15, about R-19, about R-21, about R-30, about R-38, about R-49, or about R-60. In some embodiments, the insulative material 318 may be rated about R-19. In some embodiments, the insulative material 318 may be rated about R-38. In some embodiments, the insulative material 318 is rated at least R-8, at least R-13, or at least R-19. In some embodiments, the insulative material 318 is rated about R-5 to about R-49, about R-13 to about R-49, or about R-19 to about R-45.

In illustrative embodiments, the insulative-fiber layer 336 is exposed when viewing the surface 11, as shown for example in FIGS. 7-8. Illustratively, the insulative-fiber layer 336 retains its approximate insulative value and approximate thickness when installed, for example, using method 100, as shown in FIG. 14. Illustratively, the insulated ceiling 310 can be a cathedral ceiling 310, an attic ceiling 10, or a crawl space ceiling 310, although the embodiments described herein can be applicable to a wide range of horizontal or vertical structures.

When the insulative material 318 is coupled to the deck 12, the backing layer 334 is located between the insulative-fiber layer 336 and the deck 12 as shown in FIGS. 7-8. The backing layer 334 may comprise a polyethylene, a polypropylene, a polyamide, a combination thereof, or any suitable alternative. In some embodiments, the backing layer 334 comprises a metallized foil. In some embodiments, the backing layer 334 comprises a kraft paper. In some embodiments, the backing layer 334 may be a foil-scrim-kraft material. In some embodiments, the backing layer 334 may be a polypropylene-scrim-kraft material. In some embodiments, the backing layer 334 may be a mat face material, a mesh material, or a scrim mat.

In some embodiments, the backing layer 334 is configured to provide sufficient strength and tear resistance so the insulative material 318 is retained on the deck 12. In some embodiments, the backing layer 334 comprises a reinforcing material. In some embodiments, the reinforcing material comprises fiberglass or any other suitable alternative.

In some embodiments, the backing layer 334 may act as a vapor retarder and retard the flow of vapor from the deck 12 to the insulative-fiber layer 336. In some embodiments, the backing layer 334 is non-permeable. In some embodiments, the backing layer 334 is substantially free of perforations. In some embodiments, the backing layer 334 may allow the transmission of vapor therethrough. Illustratively, the backing layer 334 may comprise a material that is permeable, include vent apertures 335, expose areas of the insulative-fiber layer 336, a combination thereof, or any suitable alternative. Illustratively, the backing layer 334 may comprise a membrane that is permeable to moisture. An exemplary embodiment of a permeable backing layer 334 is MemBrain™ produced by CertainTeed®. In some embodiments, the backing layer 34 comprises a kraft paper.

In some embodiments, the backing layer 334 has a width that is generally narrower than the width of the insulative-fiber layer 336, as suggested in FIG. 8. The width of backing layer 334 can be sized to extend between the second face 24 of the first framing member 14 and the second face 30 of the second framing member 16, as shown in FIGS. 7 and 8. In some embodiments, the width of the backing layer 334 is about the same as the width of the cavity 20. In some embodiments, the width of the backing layer 334 is less than the width of the cavity 20. In some embodiments, the width of the backing layer 334 of the backing layer 334 can be about 21 inches, about 22 inches, or about 22.5 inches. In some embodiments, the width of the insulative-fiber layer 336 is about the same as the width between the centers of the third face 26 of the first framing member 14 and the third face 32 of the second framing member 16. In some embodiments, the width of the insulative-fiber layer 336 is about 24 inches.

In some embodiments, the backing layer 334 includes an outer-backing layer 334A, a reinforcement layer 334B, and an inner-backing layer 334C, as shown in FIG. 9. The outer-backing layer 334A is arranged to form outer surface 337 of the backing layer 334. The reinforcement layer 334B extends between and interconnects the outer-backing layer 334A and the inner-backing layer 334C. The inner-backing layer 334C extends between and interconnects the reinforcement layer 334B and the adhesive layer 338.

In some embodiments, the backing layer 334 can be formed to include vent apertures 335, as shown in FIG. 9. In some embodiments, the vent apertures 335 extend through the backing layer 334 and open into the adhesive layer 338. In some embodiments, the vent apertures 335 extend from the outer-backing layer 334A through the adhesive layer 338 and open into the insulative-fiber layer 336. The vent apertures 335 that open into the insulative-fiber layer 336 may be used to allow vapor transfer through the insulative material 318.

The outer-backing layer 334A is arranged to form outer surface 337 of the backing layer 334, as shown in FIG. 9. In an illustrative embodiment, the outer-backing layer 334A comprises a metallized foil, a paper, a kraft paper, a plastic, a combination thereof, or any suitable alternative. Illustrative plastics include a polyethylene, a polypropylene, a polyamide, a combination thereof, or any suitable alternative.

The reinforcement layer 334B extends between and interconnects the outer-backing layer 334A and the inner-backing layer 334C, as shown in FIG. 9. The reinforcement layer 334B is configured to provide strength to the backing layer 334. In some embodiments, the reinforcement layer 334B is configured to receive a portion of the fastener 40 therethrough to secure the insulative material 318 to the deck 12. Illustratively, the reinforcement layer 334B comprises a scrim type material comprising fibers. Without being bound by theory, locating a portion of a fiber of the reinforcement layer 334B between a crown 50 of the fastener 40 and the deck 12 may help secure the insulative material 318 to the deck 12.

The inner-backing layer 334C extends between and interconnects the reinforcement layer 334B and the adhesive layer 338, as shown in FIG. 9. In some embodiments, the inner-backing layer 334C comprises a metallized foil, a paper, a kraft paper, a plastic, a combination thereof, or any suitable alternative. Illustrative plastics include a polyethylene, a polypropylene, a polyamide, a combination thereof, or any suitable alternative.

The insulative-fiber layer 336 is coupled to the adhesive layer 338 and extends away from the deck 12 as shown in FIGS. 7-9. In some embodiments, the insulative-fiber layer 336 comprises a glass mineral wool fiber or any suitable alternative. In some embodiments, the insulative-fiber layer 336 comprises rock wool. In some embodiments, the insulative-fiber layer 336 comprises glass wool. In some embodiments, the insulative-fiber layer 336 is a high-density fiber. In some embodiments, the insulative-fiber layer 336 further comprises a binder.

In some embodiments, the insulative-fiber layer 336 will not, or minimally, absorb water vapor. In some embodiments, the insulative-fiber layer 336 absorbs less than 5% by weight water vapor according to ASTM C1104. In some embodiments, the insulative-fiber layer 336 will not sustain mold growth. In some embodiments, the insulative-fiber layer 336 will not support microbial growth according to ASTM C1338.

The adhesive layer 338 extends between and interconnects the insulative-fiber layer 336 and the backing layer 334. In some embodiments, the adhesive layer 338 comprises an asphalt adhesive or any suitable alternative. In some embodiments, the adhesive layer 338 comprises a hot melt, a wax, a combination thereof, or any suitable alternative. In some embodiments, the adhesive layer 338 acts as a vapor barrier or a vapor retarder.

The adhesive layer 338 is generally continuous between the backing layer 34 and the insulative-fiber layer 36, as shown in FIGS. 7 and 8. Illustratively, if the backing layer 334 is permeable or the backing layer 334 includes the vent apertures 335, the sections of the backing layer 334 that are not covered with adhesive may allow vapor transfer between the deck 12 and the insulative-fiber layer 336. In some embodiments, the adhesive layer 338 has a width that is narrower than the width W2 of the backing layer 34.

The insulative material 318 is coupled to the deck 12 with a fastener 40 as shown in FIGS. 7-8. The fastener 40 extends from the insulative-fiber layer 336 through the backing layer 334 to the deck 12. In some embodiments, a portion of the insulative-fiber layer 342 is located between the fastener 40 and the backing layer 334 as shown in FIGS. 7-8. Illustratively, a first face 344 of the insulative material 18 that faces away from the deck 12 is not deformed visually when the insulative material 318 is fastened to the deck 12. In some embodiments, the fastened insulative material 318 is not appreciably compressed so the performance is maintained. Illustratively, the portion of the insulative-fiber layer 342 located between the crown 50 and the deck 12 has a density that is greater than the density of the insulative material 318 that is not located between the crown 50 and the deck 12.

Illustratively, when the backing layer 334 is formed to include the vent apertures 335, the vent apertures 335 will extend from the backing layer 334 and open into the insulative-fiber layer 336.

Illustratively, when the insulative material 318 is coupled to the deck 12 each of the first leg 46 and the second leg 48 extend from the crown 50 through the backing layer 334 into the deck 12. In some embodiments, some fibers of the insulative-fiber layer 336 are fractured by the crown 50 when stapling the insulative material 318 to the deck 12. In some embodiments, the fastener is inserted into the deck 12 on an opposite side of the deck 12 from the insulative material 318.

Illustratively, the crown 50 locates a portion of the backing layer 334 between the deck 12 and the crown 50. The crown 50 has a width as measured from the first leg 46 to the second leg 48. In some embodiments, the crown 50 may be about 0.25 inches wide. In some embodiments, the crown 50 may be about 0.5 inches wide. In some embodiments, the first leg 46 may be about 0.75 inches long. In some embodiments, the fastener 40 is a hammer-set fastener or any suitable alternative. In some embodiments, the crown 50 may be about 0.1 inches wide to about 1 inch wide, about 0.2 inches wide to about 1 inch wide, about 0.3 inches to about 1 inch wide, or about 0.4 inches wide to about 1 inch wide. In some embodiments, the crown 50 extends away about 0.1 inches to about 0.3 inches from the deck 12 after fastening the insulative material 18 to the deck 12.

Illustratively, a first face 344 of the insulative material 18 that faces away from the deck 12 is not deformed visually when the insulative material 18 is fastened to the deck 12. In some embodiments, the fastened insulative material 18 is not appreciably compressed so the performance is maintained. Illustratively, the first face 344 is generally exposed when the insulative material 18 is coupled with the surface 11.

In some embodiments, insulative material 318 is coupled with deck 12 with a plurality of fasteners 40, as suggested in FIGS. 7 and 8. In some embodiments, the insulative material 318 is coupled with the deck 12 with 1, 2, 3, 4, 5, 6, 7, 8, 9, 10, 11, 12, or 13 fasteners or any other number of suitable fasteners. In an illustrative embodiment, about 6 fasteners are used to fasten the insulative material to the deck 12, as shown in FIG. 14. The fasteners 40 may be inserted so that there are two fasteners 40 located at a first end of the batt of insulative material 318, two fasteners 40 at a second end of the batt of insulative material 318, and two fasteners 40 between the first and second ends of the batt of insulative material, as shown in FIG. 14.

Figure 10:
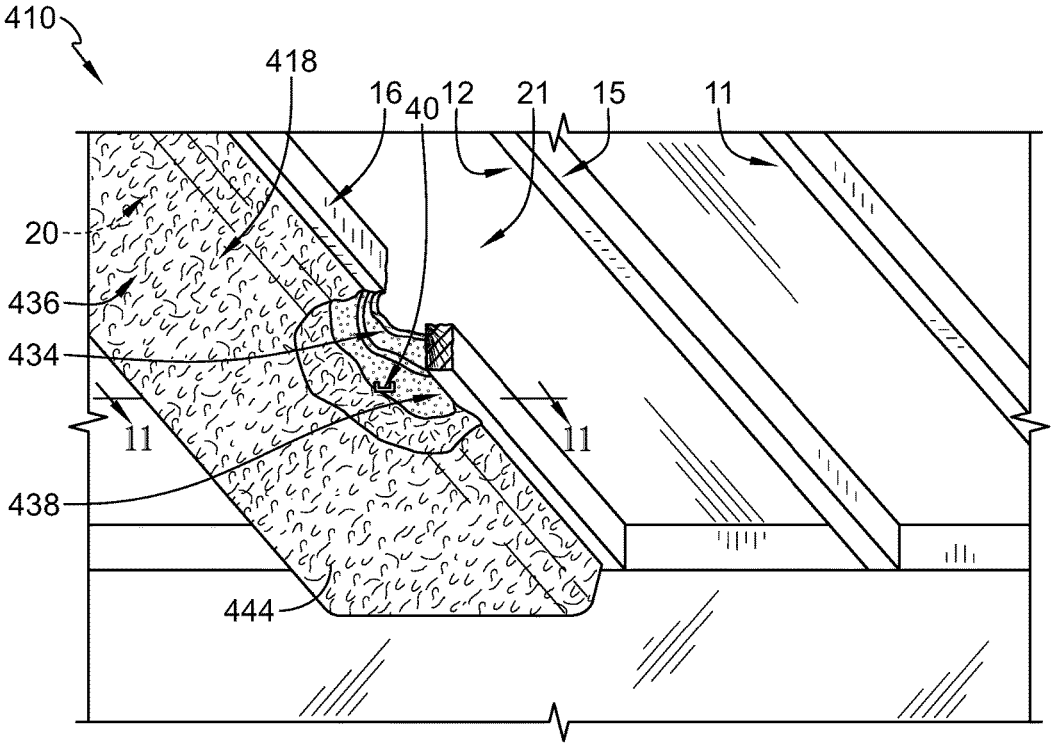
FIG. 10 is another embodiment of an insulated ceiling similar to FIGS. 1 and 8, showing portions of an insulative-fiber layer broken away to show the adhesive layer and the backing layer are formed to include vent apertures.

In another embodiment, an insulated ceiling 410 comprises an insulative material 418 coupled to a surface 11, as shown in FIG. 10. The surface 11 of FIG. 10 is similar to the surface 11 of FIG. 1, and the description of the surface 11 of FIG. 1 is incorporated herein for the ceiling 410.

Figure 11:
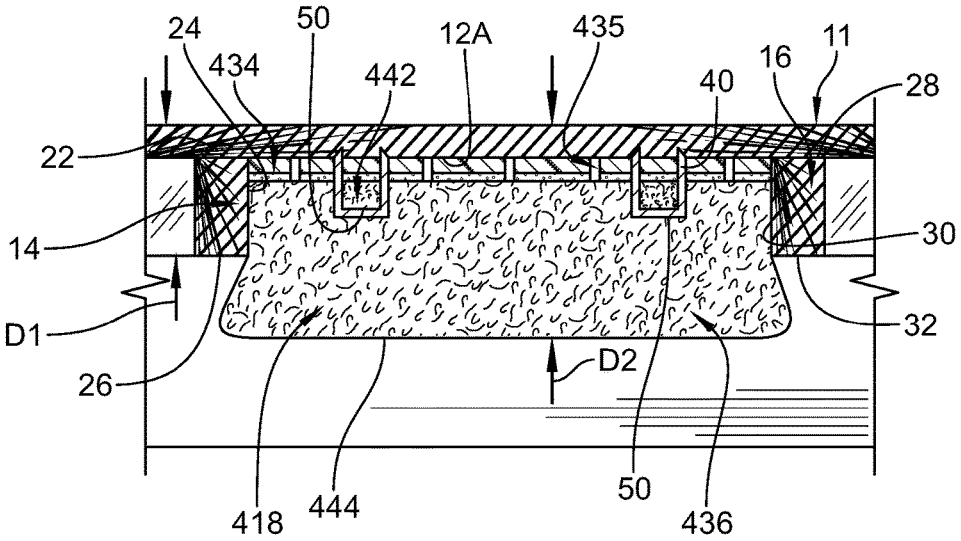
FIG. 11 is a sectional view taken along line 11-11 of FIG. 10 showing the vent apertures extending from the deck to the insulative-fiber layer.

The insulative material 418 includes a backing layer 434, an insulative-fiber layer 436, and an adhesive layer 438, as shown in FIGS. 10-11. The insulative-fiber layer 436 is coupled to the backing layer 434 with the adhesive layer 438. The adhesive layer 438 extends between the backing layer 434 and the insulative-fiber layer 436.

When the insulative material 418 is coupled to the deck 12, the backing layer 434 is located between the insulative-fiber layer 436 and the deck 12 as shown in FIGS. 10-11. The backing layer 434 may comprise a polyethylene, a polypropylene, a polyamide, a combination thereof, or any suitable alternative. In some embodiments, the backing layer 434 comprises a metallized foil. In some embodiments, the backing layer 434 comprises a kraft paper. In some embodiments, the backing layer 434 may be a foil-scrim-kraft material. In some embodiments, the backing layer 434 may be a polypropylene-scrim-kraft material. In some embodiments, the backing layer 434 may be a mat face material, a mesh material, or a scrim mat.

In some embodiments, the backing layer 434 is configured to provide sufficient strength and tear resistance so the insulative material 418 is retained on the deck 12. In some embodiments, the backing layer 434 comprises a reinforcing material. In some embodiments, the reinforcing material comprises fiberglass or any other suitable alternative.

The backing layer 434 allows the transmission of vapor therethrough. Illustratively, the backing layer 434 may comprise a material that is permeable, include vent apertures 435, expose areas of the insulative-fiber layer 436, a combination thereof, or any suitable alternative. Illustratively, the backing layer 434 may comprise a membrane that is permeable to moisture. An exemplary embodiment of a permeable backing layer 434 is MemBrain™ produced by CertainTeed®. In some embodiments, the backing layer 34 comprises a kraft paper. In some embodiments, the backing layer 434 is pin perforated to form vent apertures 435.

In some embodiments, the backing layer 434 includes an outer-backing layer, a reinforcement layer, and an inner-backing layer in a similar manner to backing layer 34.

The adhesive layer 438 extends between and interconnects the insulative-fiber layer 436 and the backing layer 434, as shown in FIG. 11. In some embodiments, the adhesive layer 438 comprises an asphalt adhesive or any suitable alternative. In some embodiments, the adhesive layer 438 comprises a hot melt, a wax, a combination thereof, or any suitable alternative. In some embodiments, the adhesive layer 438 acts as a vapor barrier. In some embodiments, the adhesive layer 438 is has a width that is narrower than the width W2 of the backing layer 434.

The backing layer 434 can be formed to include vent apertures 435, as shown in FIGS. 10-11. Illustratively, the vent apertures 435 extend from the backing layer 434 through the adhesive layer 438, as shown in FIG. 11. In some embodiments, the insulative material 418 is perforated after the insulative fiber layer 436 adheres to the backing layer 434 so that the vent apertures 435 extend from the backing layer 434 and open into the insulative fiber layer 436. Without being bound by theory, it is believed that perforating the backing layer 434 and the adhesive layer 438 will allow vapor to pass between the insulative fiber layer 436 and the deck 12.

The insulative material 418 is coupled to the deck 12 with a fastener 40 as shown in FIGS. 10-11. The fastener 40 extends from the insulative-fiber layer 436 through the backing layer 434 to the deck 12. In some embodiments, a portion of the insulative-fiber layer 442 is located between the fastener 40 and the backing layer 434 as shown in FIGS. 10-11. Illustratively, a first face 444 of the insulative material 418 that faces away from the deck 12 is not deformed visually when the insulative material 418 is fastened to the deck 12. In some embodiments, the fastened insulative material 418 is not appreciably compressed so the performance is maintained.

Figure 12:
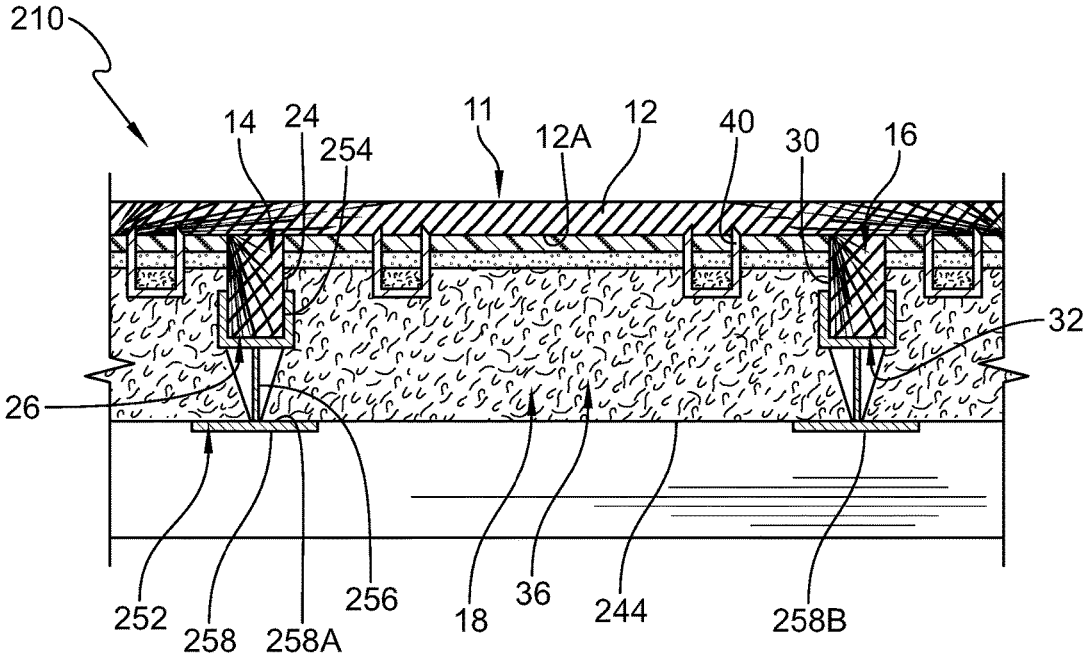
FIG. 12 is a sectional view of another embodiment of an insulated ceiling similar to FIG. 2, showing a support bracket coupled to the framing members.

In another embodiment, an insulated ceiling 210 comprises the surface 11, insulative material 18, and a support bracket 252, as shown in FIG. 12. The insulative material 18 is coupled to the deck 11 with a fastener 40 in a similar manner as insulated ceiling 10. The support bracket 252 is coupled with a first framing member 14 to support insulative material 18 as shown in FIG. 12. Illustratively, the support bracket 252 is configured to cooperate with the fasteners 40 to secure the insulative material 18 to the deck 12, as shown in FIG. 12.

Figure 13:
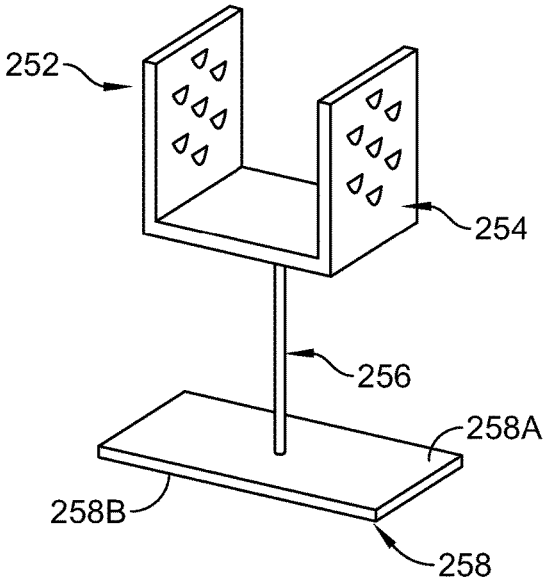
FIG. 13 is a perspective view of the support bracket of FIG. 12.

The support bracket 252 couples with the framing member 14, 16 and extends towards the first face 44 of the insulative material 18, as shown in FIG. 12. The support bracket 252 includes a framing-member attachment 254, a spacer 256, and a support platform 258 as shown in FIG. 13. The framing-member attachment 254 attaches the support bracket 252 to a framing member 15, 16. The support platform 258 is located in spaced-apart relation to the framing-member attachment 254. The spacer 256 extends between and interconnects the framing-member attachment 254 and the support platform 258.

The framing-member attachment 254 attaches the support bracket 252 to the framing members 14, 16, as shown in FIG. 12. Illustratively, the framing-member attachment 254 is generally u-shaped and extends around the third face 26, 32 of the framing members 14, 16 and up the first and second faces 22, 24, 28, 30, as shown in FIGS. 12 and 13. In some embodiments, the framing-member attachment 254 is configured to receive a fastener 40 therethrough to fasten the framing-member attachment 254 with the framing member 14, 16. In some embodiments, the framing-member attachment 254 is formed to include pins, sometimes called teeth, to couple the framing-member attachment 254 to the framing member 14, 16.

The support platform 258 is located spaced-apart from the framing-member attachment 254, as shown in FIGS. 12 and 13. The support platform 258 is configured to retain the insulative material 18 to the ceiling 210 if the fasteners 40 fail. The support platform 258 includes a first face 258A that faces towards the insulative material 18 and a second face 258B that faces away from the insulative material 18, as shown in FIGS. 12 and 13.

The spacer 256 extends between and interconnects the framing-member attachment 254 and the support platform 258, as shown in FIG. 12. The spacer 256 is sized so that the support platform 258 is adjacent to the first face 44 of the insulation. The spacer 256 can be a wire, a rod, a strap, a combination thereof, or any suitable alternative.

A method 100 of insulating a surface 11 is shown, for example, in FIG. 14. In some embodiments, the surface 11 is generally horizontal relative to the ground or the floor. In some other embodiments, the surface 11 is generally angled relative to the ground or the floor. While this method describes installing insulative material 18, the method equally applies to the other insulative materials 318, 418 described herein.

In some embodiments, the method 100 includes providing a surface 11 including the deck 12, the first framing member 14, and the second framing member 16. The first framing member 14 is generally parallel with the second framing member 16. The deck 12 generally overlies each of the first framing member 14 and the second framing member 16 to form a cavity 20 therein. In other embodiments, the surface 11 does not include the first framing member 14 or the second framing member 16.

In some embodiments, the method 100 further includes providing insulative material 18. The insulative material 18 includes the backing layer 34, the adhesive layer 38, and the insulative-fiber layer 36. The backing layer 34 and the insulative-fiber layer 36 are spaced-apart from one another. The adhesive layer 38 extends between and interconnects the insulative-fiber layer 36 and the backing layer 34. While this method describes installing insulative material 18, the method equally applies to the other insulative materials 318, 418 described herein.

In some embodiments, the method 100 further includes locating the insulative material 18 in the first cavity 20. The step of locating includes orienting the insulative material 18 so the backing layer 34 is located between the deck 12 and the insulative-fiber layer 36. Illustratively, the step of locating the insulative material 18 may be sufficient to hold the insulative material 18 within the first cavity 20. Without being bound by theory, it is believed that in some embodiments there is sufficient friction between the insulative material 18 and the framing members, 14, 15, 16 to hold the insulative material 18 in the cavity 20.

In some examples of the step of locating can be repeated so that multiple batts of insulative material 18 are located within the cavities prior to proceeding to the next step. In some examples, the step of locating may begin by inserting insulative material 18 along the eave and working up the slope of the deck 12. In some examples, the step of locating may begin by inserting insulative material 18 at the peak of the deck 12 and working down the slope of the deck 12. In some embodiments, the step of locating may begin at any point in the deck 12.

In some examples, insulation stops are inserted prior to proceeding to the next step. In some examples, insulation stops are inserted prior to the step of locating the insulation. In some examples, the insulation stops are inserted after the step of fastening the insulative material 18. Illustratively, the insulation stops may provide a space so that air may pass through the insulated space.

In some embodiments, the method 100 further includes fastening together the insulative material 18 and the deck 12. The step of fastening uses a fastener 40 that couples the insulative material 18 to the deck 12. The fastener 40 extends from the insulative-fiber layer 36 to the deck 12. In some embodiments, the fastener 40 extends from the insulative-fiber layer 36 through the backing layer 34 and into the deck 12. Illustratively, the step of fastening the fastener 40 may be performed with a pneumatic stapler, a staple gun, or any suitable alternative. Illustratively, the insulative material 18 recovers its original thickness after the step of fastening so that the first face 44 is generally uninterrupted, as shown in FIG. 14.

In some embodiments, the surface 11 further includes a third framing member 15 located spaced-apart from the first framing member 14 to locate the second framing member 16 therebetween. The third framing member 15, the second framing member 16, and the deck 12 cooperate to form a second cavity 21 therein. In some embodiments, the method 100 further includes repeating the steps of providing, the step of locating the insulative material 18 in the second cavity 21, and the step of fastening the insulative material 18 to the deck 12 in the second cavity 21 to form a continuous insulative material surface that overlies the framing members 14, 15, 16 when the surface is viewed from below.

In another embodiment, the method 100 further includes coupling the support bracket 252 to a framing member 14, 15, 16. In some embodiments, the step of coupling the support bracket 252 to the framing member is performed after the insulative material 18 is fastened to the deck 12.

In some embodiments, the mineral wool roll or batt of insulative material (e.g. insulative material 18) that has a reinforced mat/facing laminated to one of the major surfaces (e.g. backing layer 34) may be used. The insulative material (e.g. insulative material 18) may be placed with the facing side (e.g. backing layer 34) upward in a horizontal position toward the roof deck (e.g. deck 12) in an attic or facing upward toward the floor (e.g. deck 12) in a crawl space between the framing members (e.g. first framing member 14 and second framing member 16). A pneumatic staple gun may be used to fasten the underneath side of the mineral wool roll or batt (e.g. insulative material 18) directly through the insulative material (e.g. insulative-fiber layer 36) and reinforced facing (e.g. backing layer 34) into the roof deck (e.g. deck 12) or floor (e.g. deck 12) of the crawl space.

The staples (e.g. fastener 40) may hold the reinforced facing (e.g. backing layer 34) tight against the roof deck (e.g. deck 12) or flooring (e.g. deck 12) in the horizontal position and hence the insulative material (e.g. insulative material 18), since the facing (e.g. backing layer 34) is laminated to the insulative material (e.g. insulative-fiber layer 36). This application (e.g. method 100) may decrease the possibility of the insulative material (e.g. insulative material 18) falling since it is mechanically held in place by the staples (e.g. fasteners 40).

The staples (e.g. fasteners 40) may be installed using an air powered pneumatic staple gun. In some embodiments, the fasteners 40 may exit the staple gun with sufficient force to pierce through the mineral wool insulative material (e.g. insulative-fiber layer 36) and catch the reinforced facing (e.g. backing layer 34) and pin it against the roof deck (e.g. deck 12) in the attic or a subfloor (e.g. deck 12) in a crawl space. A potential benefit to this type of application may be that the insulative material (e.g. insulative material 18) may not be compressed which would allow for the full thermal performance the insulative material 18 is intended to provide.

The following numbered clauses include embodiments that are contemplated and non-limiting:

1. A method of insulating a surface comprising a deck, the method comprising locating insulative material comprising a backing layer and an insulative-fiber layer coupled with the backing layer on the surface so that the backing layer is located between the insulative-fiber layer and the deck, and fastening together the insulative material and the deck with a fastener.

2. The method of clause 1, any other clause, or any combination of clauses, wherein the fastener extends from the insulative-fiber layer through the backing layer into the deck.

3. The method of clause 2, any other clause, or any combination of clauses, wherein the fastener is a staple and includes a first leg, a second leg located in spaced-apart relation to the first leg, and a crown extending between the first leg and the second leg.

4. The method of clause 3, any other clause, or any combination of clauses, wherein a portion of the insulative-fiber layer is located between the crown and the backing layer.

5. The method of clause 4, any other clause, or any combination of clauses, wherein the portion of the insulative-fiber layer that is located between the crown and the backing layer has a density that is greater than a density of a portion of the insulative-fiber layer that is not located between the crown and the backing layer.

6. The method of clause 1, any other clause, or any combination of clauses, wherein some fibers of the insulative-fiber layer are fractured by the fastener during the step of fastening.

7. The method of clause 1, any other clause, or any combination of clauses, wherein the insulative material includes the backing layer, the insulative-fiber layer located in spaced-apart relation to the backing layer, and an adhesive layer extending between and interconnecting the backing layer and the insulative-fiber layer.

8. The method of clause 7, any other clause, or any combination of clauses, wherein the insulative-fiber layer has a width and the backing layer has a width that is generally less than the width of the insulative-fiber layer.

9. The method of clause 1, any other clause, or any combination of clauses, wherein the backing layer is formed to include vent apertures that extend through the backing layer and open into the deck.

10. The method of clause 9, any other clause, or any combination of clauses, wherein a vent aperture extends through the backing layer and opens into the insulative-fiber layer.

11. The method of clause 1, any other clause, or any combination of clauses, wherein the backing layer is non-permeable.

12. The method of clause 1, any other clause, or any combination of clauses, wherein the surface includes a first framing member and a second framing member that cooperate with the deck to form a first cavity that is sized to receive the insulative material.

13. The method of clause 12, wherein the insulative material comprises an adhesive layer that includes at least two adhesive strips spaced apart from one another and that are generally parallel to one another and the first and second framing members.

14. The method of clause 13, any other clause, or any combination of clauses, wherein the backing layer comprises vent apertures that are located between the at least two adhesive strips.

15. The method of clause 13, any other clause, or any combination of clauses, wherein each of the first and second framing members extends away from the deck a first distance and the insulative material extends away from the deck a second distance that is generally greater than the first distance.

16. The method of clause 12, any other clause, or any combination of clauses, wherein the first cavity has a width that is generally less than the width of the insulative-fiber layer.

17. The method of clause 12, any other clause, or any combination of clauses, wherein the surface further comprises a third framing member located in spaced-apart relation to the first framing member to locate the second framing member therebetween and the third framing member, the second framing member, and the deck cooperate to form a second cavity therein.

18. The method of clause 17, any other clause, or any combination of clauses, further comprising locating the insulative material in the second cavity and fastening the insulative material in the second cavity to the deck with a second fastener.

19. The method of clause 17, any other clause, or any combination of clauses, wherein when both the first cavity and the second cavity contain the insulative material, a portion of the second framing member located between the first cavity and the second cavity is not visible when the surface is viewed from below.

20. The method of clause 12, any other clause, or any combination of clauses, wherein the first cavity has a width that is generally less than the width of the insulative-fiber layer.

21. The method of clause 1, any other clause, or any combination of clauses, wherein the insulative-fiber layer comprises rock wool.

22. The method of clause 1, any other clause, or any combination of clauses, further comprising heating an adhesive layer and coupling the insulative-fiber layer to the adhesive layer and the backing layer to form the insulative material.

23. The method of clause 1, any other clause, or any combination of clauses, wherein the insulative-fiber layer has a width and the backing layer has a width that is generally less than the width of the insulative-fiber layer.

24. The method of clause 1, any other clause, or any combination of clauses, wherein the backing layer comprises a kraft paper.

25. The method of clause 1, any other clause, or any combination of clauses, wherein the backing layer comprises a kraft-scrim-kraft material.

26. The method of clause 1, any other clause, or any combination of clauses, wherein the backing layer is reinforced.

27. The method of clause 1, any other clause, or any combination of clauses, wherein the insulative material has an insulation rating of at least R-8, at least R-13, or at least R-19.

28. The method of clause 1, any other clause, or any combination of clauses, wherein the insulative material is a portion of a roll of insulative material.

29. The method of clause 1, any other clause, or any combination of clauses, wherein the insulative material is a batt of insulative material.

30. The method of clause 1, any other clause, or any combination of clauses, wherein the surface is a ceiling.

31. The method of clause 30, any other clause, or any combination of clauses, wherein the ceiling is located in an attic.

32. The method of clause 1, any other clause, or any combination of clauses, wherein the surface is located in a crawl space.

33. The method of clause 1, any other clause, or any combination of clauses, wherein the surface is a cathedral ceiling.

34. The method of clause 1, any other clause, or any combination of clauses, wherein the surface is generally horizontal relative to a ground surface.

35. The method of clause 1, any other clause, or any combination of clauses, further comprising coupling a support bracket to a first framing member.

36. The method of clause 35, any other clause, or any combination of clauses, wherein the support bracket includes a framing-member attachment, a support platform located in spaced-apart relation to the framing-member attachment, and a spacer extending between and interconnecting the support platform and the framing-member attachment.

37. The method of clause 36, any other clause, or any combination of clauses, wherein the framing-member attachment is coupled with the first framing member.

38. The method of clause 37, any other clause, or any combination of clauses, wherein the support bracket is arranged to locate a portion of the insulative material between the deck and the support platform.

39. An insulated ceiling comprising a ceiling including a deck, a first framing member, and a second framing member spaced-apart from the first framing member, and wherein the deck, the first framing member, and the second framing member cooperate to form a first cavity therebetween, insulative material extending between the first framing member and the second framing member, the insulative material including a backing layer arranged to face the deck, an insulative-fiber layer spaced-apart from the backing layer to locate the backing layer between the insulative-fiber layer and the deck, and an adhesive layer extending between and interconnecting the backing layer and the insulative-fiber layer, and a fastener extending from the insulative-fiber layer through the backing layer into the deck.

40. The insulated ceiling of clause 39, any other clause, or any combination of clauses, wherein the first and second framing members extend away from the deck a first distance and the insulative material extends away from the deck a second distance that is generally greater than the first distance.

41. The insulated ceiling of clause 39, any other clause, or any combination of clauses, wherein a portion of the insulative-fiber layer is located between the fastener and the deck.

42. The insulated ceiling of clause 41, any other clause, or any combination of clauses, wherein the portion of the insulative-fiber layer that is located between the fastener and the deck has a density that is greater than a density of a portion of the insulative-fiber layer that is not located between the fastener and the deck.

43. The insulated ceiling of clause 41, any other clause, or any combination of clauses, wherein the fastener is a staple and includes a first leg, a second leg spaced apart from the first leg, and a crown extending between the first leg and the second leg.

44. The insulated ceiling of clause 43, any other clause, or any combination of clauses, wherein each of the first leg and the second leg extends through the insulative-fiber layer and the backing layer into the deck.

45. The insulated ceiling of clause 44, any other clause, or any combination of clauses, wherein the crown locates the portion of the backing layer between the insulative-fiber layer and the deck.

46. The insulated ceiling of clause 39, any other clause, or any combination of clauses, wherein the backing layer is formed to include vent apertures.

47. The insulated ceiling of clause 39, any other clause, or any combination of clauses, wherein the backing layer is non-permeable.

48. The insulated ceiling of clause 39, any other clause, or any combination of clauses, wherein the adhesive layer is continuous between the backing layer and the insulative-fiber layer.

49. The insulated ceiling of clause 39, any other clause, or any combination of clauses, wherein the backing layer is not formed to include vent apertures.

50. The insulated ceiling of clause 39, any other clause, or any combination of clauses, wherein the adhesive layer is comprises at least two adhesive strips.

51. The insulated ceiling of clause 50, any other clause, or any combination of clauses, wherein portions of the backing layer are not covered by an adhesive strip.

52. The insulated ceiling of clause 51, any other clause, or any combination of clauses, wherein a portion of the backing layer not covered by an adhesive strip is formed to include vent apertures.

53. The insulated ceiling of clause 39, any other clause, or any combination of clauses, wherein the insulative material is about 10 inches thick.

54. The insulated ceiling of clause 39, any other clause, or any combination of clauses, wherein the insulative material is about 12 inches thick.

55. The insulated ceiling of clause 39, any other clause, or any combination of clauses, wherein each of the first framing member and the second framing member extends away from the deck up to about 4 inches.

56. The insulated ceiling of clause 39, any other clause, or any combination of clauses, wherein the insulative material extends over the first and second framing members to form a generally continuous and uninterrupted surface.

57. The insulated ceiling of clause 39, any other clause, or any combination of clauses, wherein the backing layer is reinforced.

58. The insulated ceiling of clause 39, any other clause, or any combination of clauses, wherein the ceiling has an insulation rating of at least R-8, at least R-13, or at least R-19.

59. The insulated ceiling of clause 39, any other clause, or any combination of clauses, wherein the backing layer is formed to include a plurality of vent apertures that extend through the backing layer from the deck and open into the insulative-fiber layer.

60. The insulated ceiling of clause 39, any other clause, or any combination of clauses, wherein the insulated ceiling further comprises a support bracket extending from the first framing member towards the insulative material.

61. The insulated ceiling of clause 60, any other clause, or any combination of clauses, wherein the support bracket includes a framing-member attachment, a support platform located in spaced-apart relation to the framing-member attachment, and a spacer extending between and interconnecting the support platform and the framing-member attachment.

62. The insulated ceiling of clause 61, any other clause, or any combination of clauses, wherein the framing-member attachment is coupled with the first framing member.

63. The insulated ceiling of clause 61, any other clause, or any combination of clauses, wherein the support bracket is arranged to locate a portion of the insulative material between the deck and the support platform.

64. A method of installing insulative material, the method comprising locating insulative material including a backing layer, an insulative-fiber layer, and an adhesive layer extending between and interconnecting the backing layer and the insulative-fiber layer on a surface, and coupling together the insulative material and the surface.

65. The method of clause 64, wherein the step of coupling comprises fastening together the insulative material and the surface with a fastener so that the fastener extends from the insulative-fiber layer through the backing layer to the surface to locate the backing layer between the insulative-fiber layer and the surface.

66. The method of clause 65, any other clause, or any combination of clauses, wherein the fastener is a staple.

67. The method of clause 65, any other clause, or any combination of clauses, wherein the surface includes a first framing member, a second framing member, and a deck that cooperate to form a cavity to locate the insulative material therein.

68. The method of clause 64, any other clause, or any combination of clauses, wherein the surface is generally vertical relative to a floor.

69. The method of clause 64, any other clause, or any combination of clauses, wherein the surface is generally horizontal relative to a floor.

70. The method of clause 64, any other clause, or any combination of clauses, wherein the surface is a ceiling.

71. The method of clause 64, any other clause, or any combination of clauses, wherein the step of fastening is performed with a pneumatic staple gun.

72. The method of clause 64, any other clause, or any combination of clauses, wherein the insulative material has an insulation rating of at least R-8, at least R-13, or at least R-19.

73. The method of clause 64, any other clause, or any combination of clauses, wherein the insulative material does not permanently deform visually after it is fastened to the surface.

74. An insulative material comprising, an insulative-fiber layer having a width, a backing layer having a width that is generally narrower than the width of the insulative-fiber layer, and an adhesive layer extending between and interconnecting the insulative-fiber layer and the backing layer.

75. The insulative material of clause 74, any other clause, or any combination of clauses, wherein the backing layer is permeable.

76. The insulative material of clause 75, any other clause, or any combination of clauses, wherein the backing layer comprises a material that is permeable to vapor.

77. The insulative material of clause 75, any other clause, or any combination of clauses, wherein the backing layer is formed to include a plurality of vent apertures.

78. The insulative material of clause 77, any other clause, or any combination of clauses, wherein the adhesive layer comprises at least two adhesive strips.

79. The insulative material of clause 78, any other clause, or any combination of clauses, wherein the vent apertures are located between the at least two adhesive strips.

80. The insulative material of clause 74, any other clause, or any combination of clauses, wherein the backing layer and the adhesive layer are formed to include vent apertures that extend from the backing layer through the adhesive layer and open into the insulative-fiber layer.

81. The insulative material of clause 74, any other clause, or any combination of clauses, wherein the backing layer is non-permeable.

82. The insulative material of clause 74, any other clause, or any combination of clauses, wherein the adhesive layer is continuous between the backing layer and the insulative-fiber layer.

83. The insulative material of clause 74, any other clause, or any combination of clauses, wherein the backing layer includes an outer-backing layer, a reinforcement layer, and an inner-backing layer.

84. The insulative material of clause 74, any other clause, or any combination of clauses, wherein the insulative material has a rating of at least R-11.

85. The insulative material of clause 74, any other clause, or any combination of clauses, wherein the backing layer comprises a kraft paper.

86. The insulative material of clause 74, any other clause, or any combination of clauses, wherein the backing layer comprises a kraft-scrim-kraft material.

87. A method of installing insulative material, the method comprising, locating insulative material on a surface comprising a deck, and coupling together the insulative material and the deck of the surface.

EXAMPLES

Example 1

The ability of the insulative material 18 to be retained within a cavity 20 with fasteners 40 was measured as described in this example. Briefly, five R19 and five R38 fiberglass batts of insulative material were exposed to a specified frequency, amplitude, and duration of vibration. The vibration conditions are those referenced in Test Method RDS100-3, an accredited test method performed by R&D Services, Inc. Visual observations were made on the batts after vibration, which is described below.

Identification of Insulation Tested

The insulative material 18 comprised a foil-scrim-kraft backing layer and bore the product identification of:

R19 FSK Eco Batt—product code 5001864
nominal dimensions 6.25 by 24 by 48 inches
manufactured on Sep. 2, 2016; or
R38 FSK Eco Batt—product code 5001778
nominal dimensions 12 by 24 by 48 inches
manufactured on Jul. 2, 2016

Five specimens of each product were selected from the available lots of material. The specimens were selected by dividing the number of batts of insulative material into five equal sub-lots and selecting one batt from each sub-lot.

Equipment and Installation

The insulative material used in this example were fastened to a test rack that simulated a 24-inch on-center roof cavity constructed with nominal two by four inch lumber and resembled the insulative material 18 and cavity 20 suggested in FIG. 1. The insulative material 18 was placed into the cavity 20 so that the backing layer 34 was located between the insulative-fiber layer 36 and the deck 12. In this example, the deck 12 was nominal 7/16 inch oriented strand board (OSB). The cavity 20 was about 48 inches long and open on both ends.

The test rack was mounted on an All-American Tool & Mfg. Co. vibration table, in a horizontal position. The insulative material 18 faced downward.

The insulative material 18 was fastened with the deck 12 the test cavity 20 using 0.25 inch crown, 0.5 inch leg staples as the fasteners 40. The staples were inserted into the insulative material 18 using a pneumatic staple gun set at 90 $lb/in^2$ (PSI). All batts of insulative material 18 were mounted with six staples. Four of the staples were placed six inches inside and six inches down from each corner. Two of the staples were placed 18 inches from each lengthwise edge of the cavity 20, on the center line of the cavity 20.

For the insulative material 18 rated R19, the staple gun trigger was pressed prior to pushing the staple gun into the insulative-fiber layer 36. For the insulative material rated R38, the staple gun was pushed into the insulative-fiber layer prior to the trigger being pressed. These methods allowed for some fiberglass insulative fibers to be "pinched" between the crown of the staple and the deck 12 to form the portion of the insulative fiber 42.

Vibration Protocol

The specified vibration protocol for this project was taken from Test Method RDS100-03 "Method for Determining the Resistance to Settling of Thermal Insulation Installed in Wall Cavities." The conditions of this method are shown below in Table 1

TABLE 1

Vibration Protocol

| Frequency | Amplitude | Duration |
|---|---|---|
| 15 Hz | 0.10 inch | 24 hours |

It is estimated that this set of conditions simulates the approximate kinetic energy that a residential structure will transmit to cavity insulation in a 24-year period.

Test Results

Each piece of the insulative material 18 was examined visually prior to vibration for obvious defects. Initial dimensions and mass measurements were recorded for each batt of insulative material 18. These measurements, and the calculated density, of each batt are listed in Table 2.

TABLE 2

Dimensions and Density of Test Specimens

| Specimen ID | Length (in.) | Width (in.) | Thickness (in.) | Mass (pound) | Density at recovered thickness (lb/ft$^3$) | Density at label thickness (lb/ft$^3$) |
|---|---|---|---|---|---|---|
| R19-1 | 48.17 | 24.00 | 6.46 | 2.15 | 0.50 | 0.51 |
| R19-2 | 47.67 | 24.50 | 6.05 | 2.05 | 0.50 | 0.49 |
| R19-3 | 48.00 | 24.00 | 5.52 | 1.89 | 0.51 | 0.45 |
| R19-4 | 48.33 | 23.83 | 6.66 | 2.03 | 0.46 | 0.49 |
| R19-5 | 48.17 | 23.50 | 6.33 | 1.94 | 0.47 | 0.47 |
| R38-1 | 49.00 | 24.00 | 10.30 | 4.05 | 0.58 | 0.60 |
| R38-2 | 49.00 | 24.00 | 10.30 | 4.09 | 0.58 | 0.60 |
| R38-3 | 49.67 | 24.00 | 10.20 | 4.09 | 0.58 | 0.59 |
| R38-4 | 49.00 | 24.00 | 9.44 | 3.99 | 0.62 | 0.59 |
| R38-5 | 49.17 | 24.00 | 9.41 | 4.04 | 0.63 | 0.59 |

During the vibration protocol, one batt of insulative material 18 rated R19 fell out of the cavity 20 prior to the end of the 24-hour vibration period. One batt of insulative material 18 rated R38 partially delaminated during vibration the vibration protocol.

The following observations, if present, were recorded before each 24-hour test:

Ease of installation of staples into OSB

Ease of recovery of the batt after stapling

The following observations, if present, were recorded at the end of each 24-hour test:

Separation of the insulative-fiber layer from the backing layer (adhesion)

Internal insulative-fiber layer delamination (cohesion)

Separation between the insulative material and the deck

Any physical changes resulting from the test

The condition of the staples when the insulative material is removed from the cavity Results show that 90% of the batts subjected to the vibration in this study remained in place. The following table contains observations before and after the vibration tests.

| | | |
|---|---|---|
| R19-1 | Pre-vibration observations | All staples easily inserted into the insulative-fiber layer and backing layer;<br>Insulative-fiber layer recovered to approximate label thickness. |
| | Post-vibration observations | The two middles staples pulled out of the deck while removing the insulative material from the cavity.<br>Some separation between the insulative material and the deck was observed visually. |
| R19-2 | Pre-vibration observations | 4 of 6 staples easily inserted into the insulative-fiber layer and backing layer.<br>2 staples needed to be applied a 2$^{nd}$ time to ensure good fitting.<br>The insulative-fiber layer recovered to approximate label thickness. |
| | Post-vibration observations | All staples held in place after the insulative material was removed from the cavity.<br>Some separation between the insulative material and the deck observed visually. |
| R19-3 | Pre-vibration observations | Each staple easily inserted into the insulative-fiber layer and the backing layer.<br>The insulative-fiber layer recovered to approximate label thickness. |
| | Post-vibration observations | Each staple held in place after the insulative material was removed from the cavity.<br>Some separation between the insulative material and the deck was observed visually. |
| R19-4 | Pre-vibration observations | Each staple easily inserted into the insulative-fiber layer and the backing layer.<br>The insulative-fiber layer recovered to approximate label thickness. |
| | Post-vibration observations | Each staple held in place after the insulative material was removed from the cavity.<br>Some separation between the insulative material and the deck was observed visually. |
| R19-5 | Pre-vibration observations | Each staple easily inserted into the insulative-fiber layer and the backing layer.<br>The insulative-fiber layer recovered to approximate label thickness. |
| | Post-vibration observations | The insulative material fell out of the cavity after approximately 18 hours.<br>The middle staples were all the way into the deck (no leg showing). |
| R38-1 | Pre-vibration observations | Each staple easily inserted into the insulative-fiber layer and the backing layer.<br>The insulative-fiber layer recovered to approximate label thickness. |
| | Post-vibration observations | The staples did not "pinch" any of the insulative-fiber layer between the deck and the crown of the staple after the insulative material was removed.<br>3 staples pulled out when insulative material was removed from the cavity. |
| R38-2 | Pre-vibration observations | The bottom left staple did not go into the decl.<br>Test was stopped at seven minutes and staple was re-inserted into the insulative-material.<br>No issues were observed after the staple was re-inserted.<br>The insulative-fiber layer recovered to approximate label thickness. |
| | Post-vibration observations | Two staples pulled out of the deck during the removal of the insulative material from the cavity.<br>Insulative fibers were "pinched" between the crown of the staple and the deck in only one staple after the insulative material was removed. |
| R38-3 | Pre-vibration observations | Each staple easily inserted into the insulative-fiber layer and the backing layer.<br>The insulative-fiber layer recovered to approximate label thickness. |
| | Post-vibration observations | Each staple held in place after the insulative material was removed from the cavity.<br>Portions of the insulative-fiber layer were "pinched" in-between the crown of the staple and the deck in two staples only. |
| R38-4 | Pre-vibration observations | Each staple easily inserted into the insulative-fiber layer and the backing layer.<br>The insulative-fiber layer recovered to approximate label thickness. |
| | Post-vibration | Each staple held in place after the insulative |

-continued

| | | |
|---|---|---|
| | observations | material was removed from the cavity.<br>Portions of the insulative-fiber layer were "pinched" in-between the crown of the staple and the deck in three staples only. |
| R38-5 | Pre-vibration observations | Each staple easily inserted into the insulative-fiber layer and the backing layer.<br>The insulative-fiber layer recovered to approximate label thickness. |
| | Post-vibration observations | All staples held in place after batt was removed from cavity.<br>Some delamination within insulative-fiber layer was visually observed. |

Example 2

Five pieces, or batts, of insulative material 18 rated R19 were tested as described in Example 1. Briefly, the batts of the insulative material 18 were exposed to a specified frequency, amplitude, and duration of vibration.

The backing layer 34 of the insulative material 18 comprised a kraft-scrim-kraft material and bore the product identification of:

R19 KSK Eco Batt

Nominal dimensions 6.25 by 24 by 48 inches

Batts contained a KSK (Kraft-Scrim-Kraft) backing layer

Five specimens were selected from the available lot of material. The specimens were selected by dividing the number of batts of the insulative material into five equal sub-lots and selecting one batt from each sub-lot.

Equipment and Installation

The insulative material 18 in this Example was installed as described in Example 1.

Vibration Protocol

The vibration protocol was performed as described in Example 1.

Test Results

Each piece of insulative material was examined visually prior to vibration for obvious defects. Initial dimensions and mass measurements were recorded for each batt of insulative material. These measurements, and the calculated density, of each piece of insulative material are listed in Table 3.

Table 3: Dimensions and Density of Test Specimens

| Specimen ID | Length (in.) | Width (in.) | Thickness (in.) | Mass (pound) | Density at recovered thickness ($lb/ft^3$) | Density at label thickness ($lb/ft^3$) |
|---|---|---|---|---|---|---|
| R19-1 | 48.17 | 24.00 | 6.77 | 2.11 | 0.47 | 0.51 |
| R19-2 | 48.00 | 24.00 | 6.68 | 2.14 | 0.48 | 0.51 |
| R19-3 | 48.00 | 24.00 | 6.95 | 2.05 | 0.44 | 0.49 |
| R19-4 | 48.50 | 24.00 | 6.84 | 1.90 | 0.41 | 0.45 |
| R19-5 | 48.17 | 23.50 | 5.43 | 2.03 | 0.57 | 0.50 |

There was no observation of any piece of insulative material falling out of the cavity or delaminating from the backing layer.

The following observations, if present, were recorded before each 24-hour test:

Ease of installation of staples into the deck

Ease of recovery of the insulative-fiber layer after stapling

The following observations, if present, were recorded at the end of each 24-hour test:

Separation of the insulative-fiber layer from the backing layer (adhesion)

Internal insulative-fiber layer delamination (cohesion)

Separation between the insulative material and the deck

Any physical changes resulting from the test

The condition of the staples when the insulative material is removed from the cavity Results show that each of the batts of insulative material subjected to the protocol in this example remained in place. The following table contains observations before and after the vibration tests.

| | | |
|---|---|---|
| R19-1 | Pre-vibration observations | Each staple easily inserted into the insulative-fiber layer and the backing layer.<br>The insulative-fiber layer recovered to approximate label thickness. |
| | Post-vibration observations | One staple pulled out of the deck during the removal of the insulative material from the cavity.<br>The insulative material did not separate from cavity. |
| R19-2 | Pre-vibration observations | 5 of 6 staples easily inserted into insulative-fiber layer and backing layer.<br>1 staple needed to be applied a 2nd time to ensure good fitting.<br>The insulative-fiber layer recovered to approximate label thickness. |
| | Post-vibration observations | Three staples pulled out of the deck during the removal of the insulative material batt from the cavity.<br>The insulative material did not separate from cavity. |
| R19-3 | Pre-vibration observations | Each staple easily inserted into the insulative-fiber layer and the backing layer.<br>The insulative-fiber layer recovered to approximate label thickness. |
| | Post-vibration observations | Each staple held in place after the insulative material was removed from cavity.<br>The insulative material did not separate from cavity. |
| R19-4 | Pre-vibration observations | Each staple easily inserted into the insulative-fiber layer and the backing layer.<br>The insulative-fiber layer recovered to approximate label thickness. |
| | Post-vibration observations | Each staple held in place after the insulative material was removed from cavity.<br>The insulative material did not separate from cavity. |
| R19-5 | Pre-vibration observations | Each staple easily inserted into the insulative-fiber layer and the backing layer.<br>The insulative-fiber layer recovered to approximate label thickness. |
| | Post-vibration observations | Each staple held in place after the insulative material was removed from cavity.<br>The insulative material did not separate from cavity. |

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. An insulated ceiling comprising a ceiling including a deck, a first framing member, and a second framing member spaced-apart from the first framing member, wherein the deck, the first framing member, and the second framing member cooperate to form a first cavity therebetween, and wherein the deck extends generally perpendicular between the first framing member and the second framing member, insulative material extending along a bottom surface of the deck between the first framing member and the second framing member, the insulative material including a backing layer arranged to face the deck, an insulative-fiber layer spaced-apart from the backing layer to locate the backing layer between the insulative-fiber layer and the deck, and an adhesive layer extending between and interconnecting the backing layer and the insulative-fiber layer, and a fastener extending from the insulative-fiber layer through the backing layer into the bottom surface of the deck, wherein the backing layer is located on a first side of the insulative material and the insulative material is exposed on a second side that is opposite the backing layer;

wherein the fastener is fastened through the second side of the insulative material such that the insulative material is not appreciably compressed so that insulative performance is maintained; and wherein a portion of the insulative material is located between the fastener and the deck so that the portion of the insulative material that is located between the fastener and the deck has a density that is greater than a density of a portion of the insulative material that is not located between the fastener and the deck.

2. The insulated ceiling of claim 1, wherein the first and second framing members extend away from the deck a first distance and the insulative material extends away from the deck a second distance that is greater than the first distance.

3. The insulated ceiling of claim 2, wherein the ceiling has an insulation rating of at least R-8, at least R-13, or at least R-19.

4. The insulated ceiling of claim 2, wherein the insulative material extends over the first and second framing members to form a generally continuous and uninterrupted surface.

5. The insulated ceiling of claim 2, wherein the insulative material extends over the first and second framing members to form a thermal block.

6. A method of insulating a bottom of a surface comprising a deck, the method comprising locating insulative material comprising a backing layer and an insulative-fiber layer coupled with the backing layer on the surface so that the backing layer is located between the insulative-fiber layer and the deck, and fastening together the insulative material and the deck with a fastener that extends from the insulative-fiber layer through the backing layer into a bottom surface of the deck, wherein the surface includes a first framing member and a second framing member, wherein the deck is planar perpendicularly with the first framing member and the second framing member, wherein the backing layer is located on a first side of the insulative material and the insulative material is exposed on a second side that is opposite the backing layer;

wherein the fastener is fastened through the second side of the insulative material such that the insulative material is not appreciably compressed so that insulative performance is maintained; and wherein a portion of the insulative material is located between the fastener and the deck so that the portion of the insulative material that is located between the fastener and the deck has a density that is greater than a density of a portion of the insulative material that is not located between the fastener and the deck.

7. The method of claim 6, wherein the fastener is a staple and includes a first leg, a second leg located in spaced-apart relation to the first leg, and a crown extending between the first leg and the second leg.

8. The method of claim 7, wherein a portion of the insulative-fiber layer is located between the crown and the backing layer.

9. The method of claim 8, wherein the portion of the insulative-fiber layer that is located between the crown and the backing layer has the density that is greater than the density of the portion of the insulative-fiber layer that is not located between the crown and the backing layer.

10. The method of claim 6, wherein fibers of the insulative-fiber layer are fractured by the fastener during the step of fastening.

11. The method of claim 6, wherein the insulative material includes the backing layer, the insulative-fiber layer located in spaced-apart relation to the backing layer, and an adhesive layer extending between and interconnecting the backing layer and the insulative-fiber layer.

12. The method of claim 11, wherein the insulative-fiber layer has a width and the backing layer has a width that is less than the width of the insulative-fiber layer.

13. The method of claim 12, wherein the backing layer is formed to include vent apertures that extend through the backing layer and open into the deck.

14. The method of claim 12, wherein the backing layer is non-permeable to moisture.

15. The method of claim 6, wherein each of the first and second framing members extends away from the deck a first distance and the insulative material extends away from the deck a second distance that is greater than the first distance.

16. The method of claim 15, wherein the cavity has a width that is less than or equal to the width of the insulative-fiber layer.

17. The method of claim 15, wherein the insulative material extends over the first and second framing members to form a thermal block.

18. The method of claim 6, wherein the insulative material has a rating in a range of about R-5 to about R-49.

* * * * *